US006224323B1

(12) United States Patent
Murase et al.

(10) Patent No.: US 6,224,323 B1
(45) Date of Patent: May 1, 2001

(54) IMPELLER OF MOTOR-DRIVEN FUEL PUMP

(75) Inventors: Seiji Murase; Shinichi Fujii; Takayuki Usui; Satoru Ikeda, all of Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 0 days.

(21) Appl. No.: 09/269,739

(22) PCT Filed: Jun. 15, 1998

(86) PCT No.: PCT/JP98/02657

§ 371 Date: Apr. 6, 1999

§ 102(e) Date: Apr. 6, 1999

(87) PCT Pub. No.: WO99/07990

PCT Pub. Date: Feb. 18, 1999

(30) Foreign Application Priority Data

Aug. 7, 1997 (JP) ..... 9-213540

(51) Int. Cl.[7] ..... F01D 1/12; B63H 1/26

(52) U.S. Cl. ..... 415/55.1; 416/197 B

(58) Field of Search ..... 415/55.1, 55.2, 415/55.3, 55.4, 55.5, 55.6, 55.7

(56) References Cited

U.S. PATENT DOCUMENTS

| | | | | |
|---|---|---|---|---|
| 1,861,839 | * | 6/1932 | Burks | 415/55.1 X |
| 3,392,675 | * | 7/1968 | Taylor | 415/55.4 |
| 5,310,308 | * | 5/1994 | Yu et al. | 415/55.6 |
| 5,330,319 | * | 7/1994 | Yu et al. | 415/55.1 |
| 5,468,119 | * | 11/1995 | Huebel et al. | 415/55.1 |
| 5,472,321 | | 12/1995 | Radermacher . | |
| 5,487,639 | * | 1/1996 | Asabuki et al. | 415/55.1 |
| 5,601,398 | * | 2/1997 | Treiber et al. | 415/55.1 |
| 5,807,068 | | 9/1998 | Dobler et al. . | |

FOREIGN PATENT DOCUMENTS

| | | |
|---|---|---|
| 89070453 | 12/1989 | (DE) . |
| 3925396 | 2/1991 | (DE) . |
| 19504079 | 8/1996 | (DE) . |
| 318026 | 8/1929 | (GB) . |
| 6299983 | 10/1994 | (JP) . |
| 7-54726 | 2/1995 | (JP) . |
| 7189973 | 7/1995 | (JP) . |

* cited by examiner

*Primary Examiner*—John E. Ryznic
(74) *Attorney, Agent, or Firm*—Dennison, Scheiner, Schultz & Wakeman

(57) ABSTRACT

Vanes (73) are provided on the outer peripheries of both surfaces of an impeller in a circumferential direction, and vane grooves (72) are provided between the vanes. The vane grooves are formed to be curvilinear as viewed from a radial cross section. Also, connections of the vane grooves (72) with end surfaces (74) of the vanes are formed to be curvilinear as viewed from a circumferential cross section, and portions which extend from a forward side of a direction of rotation toward the connections are formed to be curvilinear. Communication holes (76) are formed forwardly or rearwardly of the vane grooves in the direction of rotation to allow communication between the vane grooves on both surfaces. An opening of the vane grooves is formed into various shapes, for example, straight in a radial direction, curved in the direction of rotation, or inclined in the direction of rotation.

9 Claims, 20 Drawing Sheets

IMPELLER OF MOTOR-DRIVEN FUEL PUMP

TECHNICAL FIELD

The present invention relates to an impeller for an electro-drive type fuel pump.

BACKGROUND ART

FIG. 1 shows an electro-drive type fuel pump of an in-tank system, which is installed in a fuel tank. The electro-drive type fuel pump illustrated in FIG. 1 is composed of a motor portion 1 and a pump portion 2, which are incorporated in a cylindrically formed housing 3. A motor cover 4 and a pump cover 5 are attached to the upper and lower end portions of the ahousing 3.

By supporting the upper and lower end portions of a shaft 8 at the motor cover 4 and the pump cover 5 via bearings 9 and 10, respectively, an armature 7 is disposed in a motor chamber 6 so as to rotate therein. A plurality of commutator segments 12, which are connected to a coil and which are composed of copper and silver as their principal components, are disposed on the armature 7 and are insulated from each other. A magnet 11 is disposed on the inner wall surface of the housing 3. A brush 13, which can slidingly contact the commutator segments 12 of the armature 7, and a spring 14 that biases the brush 13 are incorporated in the motor cover 4. The brush 13 is connected to an external connection terminal via a choke coil 15.

A check valve 17 is incorporated in a discharge port 16 secured to the motor cover 4, and a fuel feeding pipe is connected to the discharge port 16. A pump body 18 is attached to the lower end portion of the housing 3 by caulking it to the lower side of the pump cover 5. A fuel inlet opening 19 is provided in the pump body 18 and a fuel outlet opening 20 is provided in the pump cover 5. The inlet opening 19 and the outlet opening 20 are provided at positions separated from each other in the circumferential direction of the pump chamber formed by the pump body 18 and pump cover 5. A disk-shaped impeller 21 having a plurality of blade grooves 22 formed on the upper and lower sides in the circumferential direction is disposed in the pump chamber formed by the pump body 18 and the pump cover 5. The impeller 21 is formed of resin, etc., and is fitted onto the shaft 8 of the armature 7.

In an electro-drive type fuel pump constructed as described above, when the motor portion 1 is energized to rotate the armature shaft 8, the impeller 21 is driven for rotation. As the result, fuel in the fuel tank is drawn up through the inlet opening 19 and enters the motor chamber 6 through the outlet opening 20, and the fuel is discharged to a fuel feeding pipe through the discharge portion 16.

A known impeller is described in Japanese Laid-open Patent Publication No. 7-54726. FIGS. 2 through 5 show the known impeller. FIG. 2 is a perspective view of the impeller, FIG. 3 is an enlarged view of section III identified in FIG. 2, FIG. 4 is a sectional view (sectional view taken in the radial direction) taken along the line IV—IV in FIG. 3 and FIG. 5 is a sectional view (sectional view taken in the circumferential direction) taken along the line V—V in FIG. 3. Blades 23 are provided along the circumferential direction on the outer circumferential portion of both sides of the impeller 21 and a blade groove 22 is formed between the blades 23. A flow line groove 35 is formed at portions of the pump cover 5 and the pump body 18 that correspond to the blade grooves 22 of the impeller 21. Thus, the flow line groove 35 forms a flow line 36 from the inlet opening 19 to the outlet opening 20. In the radial direction sectional view, the blade grooves 22 are formed in a curved shape as shown in FIG. 4.

Furthermore, in the circumferential direction view, the blade grooves 22 are formed in a rectilinear shape that is parallel to the plane of the impeller as shown in FIG. 5. The connection portion 26 between the end face 24 of the blade 23 at the front side of the rotational direction and the end face 25 of the blade 23 at the rear side of the rotational direction has a right angle, that is, a rectangular shape. An opening portion of the blade groove 22 is formed so that the opening edge portion 28 in the radial direction at the rear side of the rotational direction has a rectilinear shape as shown in FIG. 3, and at the same time, connection portions 31 and 32 between the opening edge portion 28 and the opening edge portion 29 or 30 in the circumferential direction has a right angle.

In such a known impeller 21, when fuel flows from the inlet opening 19 to the outlet opening 20, a circulating vortex flow is generated wherein fuel flows outward of the radial direction along the blade grooves 22 of the impeller 21 as shown by the arrows in FIG. 4 and collides with the wall surface in the radial direction of the flow line 36. The fuel flows inwardly in the radial direction along the flow line groove 35 and again flows outward of the radial direction along the blade grooves 22. Because the speed of the circulating vortex flow in the circumferential direction is slower than the peripheral speed of the impeller 21, the fuel that flows inwardly in the radial direction along the flow line groove 36 is caused to flow in the blade grooves 22 at the rear side of the rotational direction. At this time, because the connection portions between the blade grooves 22 and the end faces 24 or 25 of the blade 23 are formed to a right angle when viewed in the circumferential direction, the speed of the circulating vortex flow in the circumferential direction is decelerated by fluid resistance at the right angled connection portion 26, and thus, pump efficiency was not satisfactory.

Furthermore, an impeller in which blades are inclined in the rotational direction as described in Japanese Laid-open Patent Publication No. 6-299983, and an impeller in which the blades are chamfered as described in Japanese Laid-open Patent Publication No. 7-189973, etc., has been described.

However, with respect to impellers in which blades are inclined in the rotational direction and blades or chamfered, the number of resin materials can form the impeller are limited, because the impeller shape is complicated. In particular, it becomes difficult to mold the impellers with thermosetting resin. Because the strength, anti-swelling properties when contacting with gasoline, etc., of thermosetting resins are higher than those of thermoplastic resins, etc., reliability may be a problem if the impellers are made of a resin such as thermoplastic resin, etc., other than the thermosetting resin, etc.

Further, because the opening edge portion 28 in the radial direction at the rear side of the rotational direction of the opening portion of the blade grooves 22 shown in FIG. 3 has a rectilinear shape, and the connection portions 31 and 32 between the opening edge portion 28 and the opening edge portion 29 in the circumferential direction outward of the radial direction or the opening edge portion 30 in the circumferential direction inwardly in the eradial direction have a right angle, the speed of a circulating vortex flow flowing out from the blade grooves 22 in the circumferential direction is decelerated, and inflow of fuel into the blade grooves 22 is not smooth. Therefore, pump efficiency is not satisfactory.

In addition, although vapor exhaust port 37 that exhausts vapor (air bubbles) in the blade grooves 22 is disposed in one flow line groove 35 of the pump cover 5 or the pump body 18, vapor in the blade grooves 22 that is disposed in the side opposite of the vapor exhaust port 37 cannot be immediately exhausted through the vapor exhaust port 37. Therefore, pump efficiency is not satisfactory. Further, because the outlet opening 20 is provided at one side (the upper side in the case of FIG. 1) of both upper and lower sides of the impeller 21, fuel in the blade grooves 22 opposite to the side where the outlet opening 20 is disposed scarcely flows into the outlet opening 20 side. Therefore, pump efficiency is not satisfactory.

It is, accordingly, an object of the invention to provide an impeller for an electro-drive type fuel pump that is capable of improving pump efficiency with a simple shape or construction.

DISCLOSURE OF THE INVENTION

The invention provides an impeller for an electro-drive type fuel pump having blades and blade grooves that are provided along the circumferential direction, wherein the blade grooves have a curved shape when observed in sectional view thereof in the radial direction, and wherein connection portions between the blade grooves and end faces of the blades at the rear side of the rotational direction are have a curved shape when observed in sectional view thereof in the circumferential direction.

The invention also provides an impeller for an electro-drive type fuel pump in which the connection portions are circular.

Further, the invention provides an impeller for an electro-drive type fuel pump in which the blade grooves are formed and inclined from the front side of the rotational direction toward the connection portions when observed in sectional view thereof in the circumferential direction.

The invention also provides an impeller for an electro-drive type fuel pump in which opening portions of the blade grooves are constructed such that the connection portions between the opening edge portions in the radial direction at the rear side of the rotational direction and the opening edge portions in the circumferential direction outward of the radial direction have a curved shape.

Furthermore, the invention provides an impeller for an electro-drive type fuel pump in which the opening portions of the blade grooves are constructed such that the opening edge portions in the radial direction at the rear side of the rotational direction have a curved shape.

The invention additionally provides an impeller for an electro-drive type fuel pump in which the opening portions of the blade grooves are constructed such that the connection portions between the opening edge portions in the radial direction at the rear side of the rotational direction and the opening edge portions in the circumferential direction inward of the radial direction have a curved shape.

The invention also provides an impeller for an electro-drive type fuel pump in which the opening portions of the blade grooves are formed and inclined relative to the radial direction.

With the above-mentioned construction, fuel smoothly flows and a speed vector in the circumferential direction is provided for the circulating vortex flow from the blade groove, because fluid resistance of the blade groove is reduced, so that pump efficiency can be improved.

The invention provides an impeller for an electro-drive type fuel pump having blades and blade grooves that are provided along the circumferential direction on both sides thereof, wherein communicating holes are formed to communicate fuel between the blade grooves on both sides.

The invention also provides an impeller for an electro-drive type fuel pump in which the communicating holes are formed to extend over the blade grooves in the radial direction thereof.

The invention also provides an impeller for an electro-drive type fuel pump in which the communicating holes are formed at the rear side of the rotational direction of the blade grooves.

The invention further provides an impeller for an electro-drive type fuel pump in which the communicating holes are formed at the front side of the rotational direction of the blade grooves.

Furthermore, the invention provides an impeller for an electro-drive type fuel pump in which the blade grooves facing the outlet side are formed to shift toward the rear side of the rotational direction relative to the blade grooves facing the inlet side.

With the construction described above, it is possible to improve the vapor exhaust capacity of the blade grooves, or it is possible to improve the fuel exhaust capacity of the blade grooves. Therefore, pump efficiency can be further improved.

Because the above-mentioned construction is further simplified, it is possible to form impellers with a thermosetting resin, etc.

BEST MODE FOR CONSTRUCTING THE INVENTION

Figure 6:
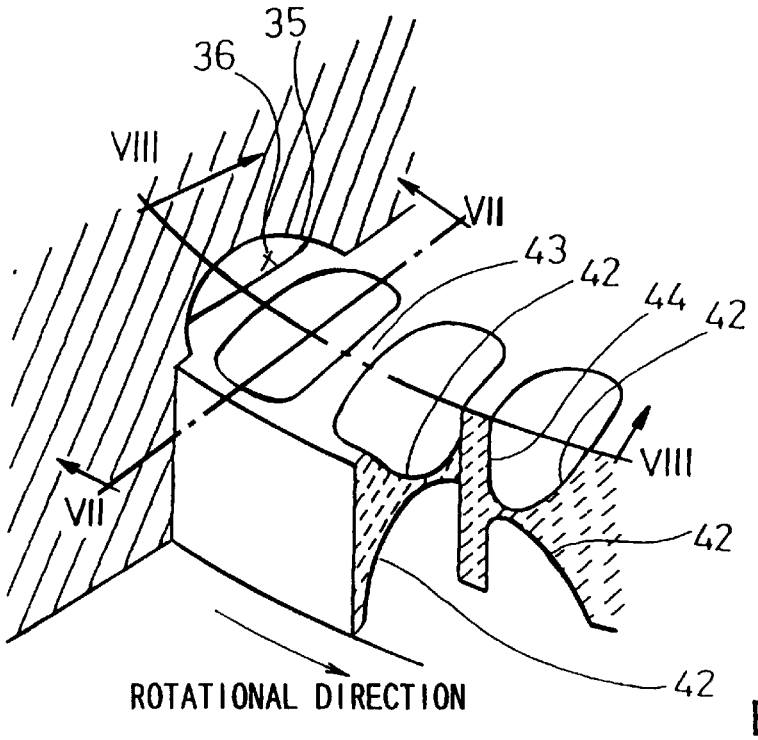
FIG. 6 is a fragmentary sectional view of an impeller according to a first preferred embodiment.
Figure 7:
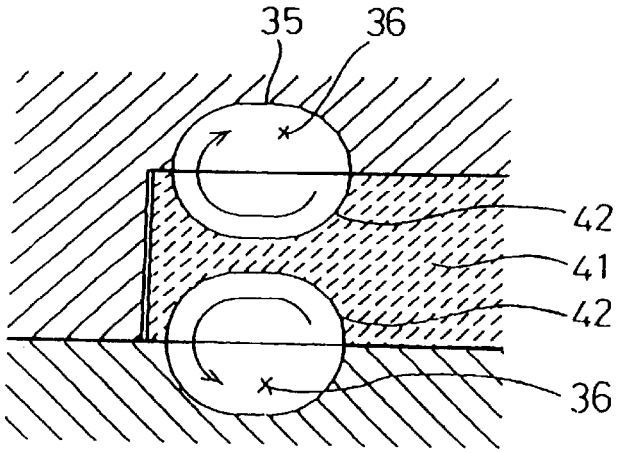
FIG. 7 is a sectional view taken along the line VII—VII in FIG. 6.
Figure 8:
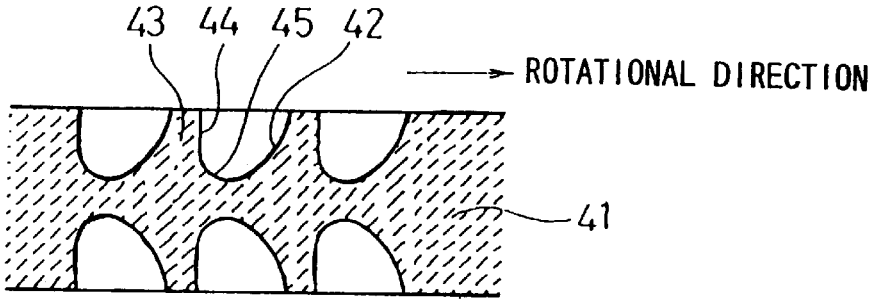
FIG. 8 is a sectional view taken along the line VIII—VIII in FIG. 6.

A first preferred embodiment of an impeller according to the invention is illustrated in FIGS. 6 through 8. FIG. 6 is a fragmentary sectional view showing a blade and a blade groove. FIG. 7 is a sectional view (sectional view in the radial direction) taken along the line VII—VII in FIG. 6, and FIG. 8 is a sectional view (sectional view in the circumferential direction) taken along the line VIII—VIII in FIG. 6.

Blades 43 are provided along the circumferential direction on the outer circumference at both sides of an impeller 41 and blade grooves 42 are formed between the blades 43. The blade grooves 42 have a curved shape as shown in FIG. 7, when observed in sectional view thereof in the radial direction. When observed in sectional view thereof in the circumferential direction, as shown in FIG. 8, a connection portion 45 between the blade grooves 42 and the end face 44 of the blade 43 at the rear side of the rotational direction has a curved shape, for example, a circular or elliptical shape. Further, the blade grooves are formed and inclined into a curved shape, for example, a circular shape, from the front side of the rotational direction toward the connection portion 45.

By forming the connection portion 45 between the blade grooves 42 and the end face 44 of the blade 43 into a curved shape when observed in sectional view thereof in the circumferential direction, fluid resistance in the circumferential direction can be suppressed to a reduced level, peripheral speed of a vortex flow from the blade grooves at the front side of the rotational direction can be increased.

Figure 5:
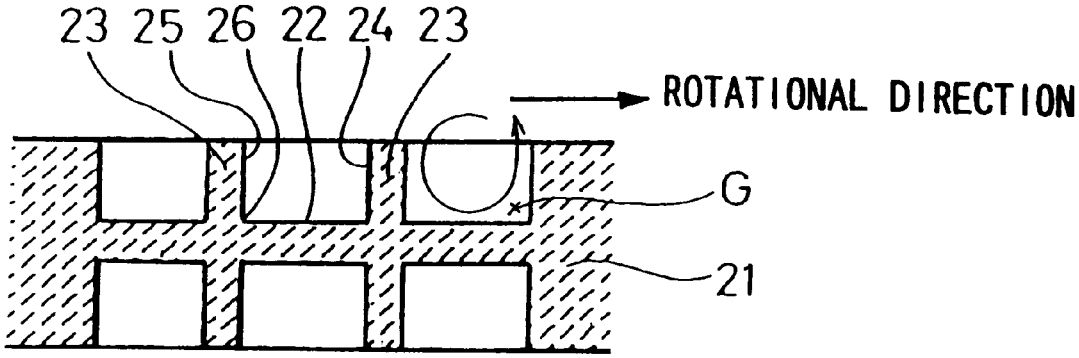
FIG. 5 is a sectional view taken along the line V—V in FIG. 3.

In addition, with the known impeller, as shown in FIG. 5, stagnation occurs at the portion G of the connection portion between the blade grooves 22 and the end face 24 of the blade 23 at the front side of the rotational direction, thereby decreasing efficiency. In the preferred embodiment, because the blade grooves 42 are formed and inclined into a curved shape from the front side of the rotational direction toward the connection portion 45 when observed in sectional view thereof in the circumferential direction, fluid resistance between the front side of the rotational direction and the connection portion can be suppressed to a reduced level, so that the occurrence of stagnation can be prevented. Therefore, pump efficiency can be further improved. Further, because the construction of the blade groove 42 is simple, it is possible to mold the impeller from a thermosetting resin and the reliability thereof is improved.

With regard to the shape of the blade grooves, it is satisfactory that the connection portion between the blade grooves and at least the end face of the blade at the rear side of the rotational direction has a curved shape when observed in section thereof in the circumferential direction.

Figure 9:
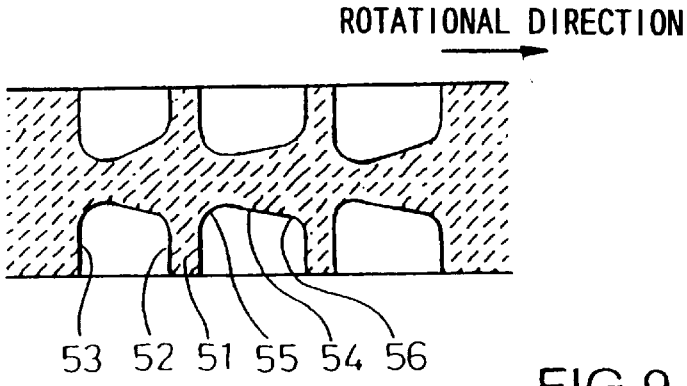
FIG. 9 is a circumferentially sectional view of an impeller according to a second referred embodiment.

FIG. 9 shows a second preferred embodiment in which the sectional shape of the blade grooves in the circumferential direction has been modified. The blade grooves 54 illustrated in FIG. 9 are formed and inclined into a rectilinear shape from the front side of the rotational direction toward the rear side of the rotational direction when observed in sectional view thereof in the circumferential direction. The connection 55 between the blade groove 54 and the end face 53 of a blade 51 at the rear side of the rotational direction, and the connection portion 56 between the blade groove 54 and the end face 52 of the blade 51 at the front side of the rotational direction have a curved shape, for example, a circular shape. Further, the end face 52 of the blade 51 at the front side of the rotational direction can be omitted. In this preferred embodiment, it is possible to suppress fluid resistance in the circumferential direction to a reduced level, as was the case in the preferred embodiment shown in FIG. 8, and it is also possible to suppress the fluid resistance between the front side of the rotational direction and the connection portion 55 to a lower level.

Figure 10:
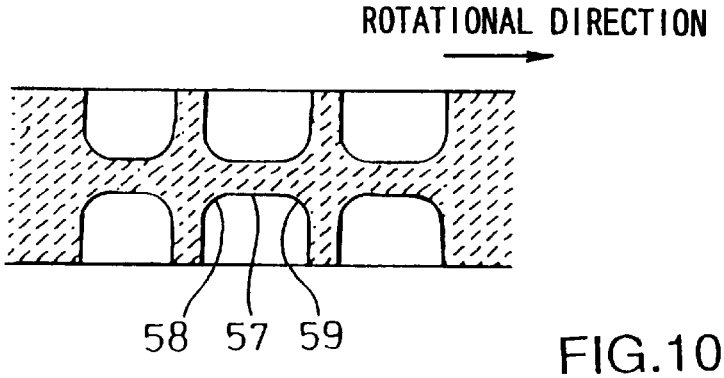
FIG. 10 is a circumferentially sectional view of an impeller according to a third preferred embodiment.

A third preferred embodiment is illustrated in FIG. 10, in which the sectional shape of the blade groove in the circumferential direction has been modified. The blade groove 57 illustrated in FIG. 10 has a rectilinear shape, and is substantially parallel to the impeller plane when observed in section thereof in the circumferential direction, wherein the connection portion 58 between the blade groove 57 and the end face of the blade at the rear side of the rotational direction and the connection portion 59 between the blade groove 57 and the end face of the blade at the front side of the rotational direction has a curved shape, for example, a circular shape. In this preferred embodiment, it is possible to suppress the fluid resistance in the circumferential direction to a reduced level, as was the case in the preferred embodiment illustrated in FIG. 8.

Figure 11:
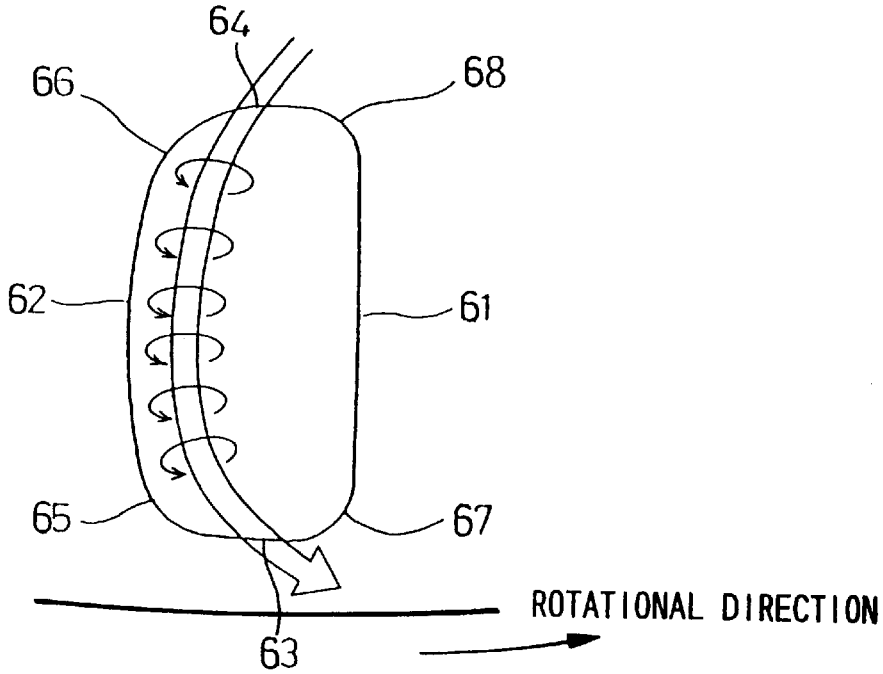
FIG. 11 is a view showing an opening portion of an impeller according to a fourth preferred embodiment.

In the above embodiment, although a description was provided to improve pump efficiency by modifying the sectional shape of the blade grooves in the circumferential direction, pump efficiency can be improved by modification of the shape of the opening portion of the blade grooves. FIG. 11 shows a fourth preferred embodiment in which the shape of the opening portion of the blade grooves has been modified. In FIG. 11, the opening portion of the blade grooves has an opening edge portion 61 in the radial direction on the front side of the rotational direction, an opening edge portion 62 in the radial direction on the rear side of the rotational direction, an opening edge portion 63 in the circumferential direction peripheral to the radial direction, and an opening edge portion 64 in the circumferential direction inward of the radial direction. The connection portion 65 between the opening edge portion 62 and the opening edge portion 63, the connection portion 66 between the opening edge portion 62 and the opening edge portion 64, and the opening edge portion 62 all have a curved shape, for example, a circular shape.

Figure 12:
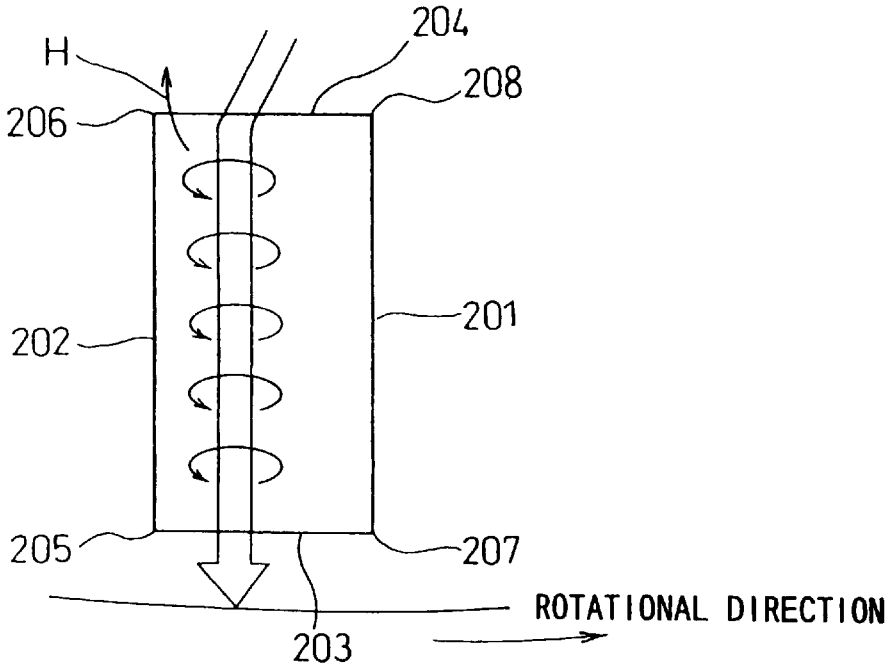
FIG. 12 is a view showing an opening portion of a known impeller.

With a known impeller shown in FIG. 12, because the opening portion of the blade grooves is constructed such that the connection portion 206 between the opening edge portion 202 in the radial direction of the rear side of the rotational direction and the opening edge portion 204 in the circumferential direction inward of the radial direction have a rectangular shape, reverse flow occurs in the direction of the arrow H relative to vortex flow. Therefore, pump efficiency is not satisfactory. In addition, because the connection portion between the opening edge portion 202 in the radial direction of the rear side of the rotational direction and the opening edge portion 203 in the circumferential direction peripheral to the radial direction has a rectangular shape, a speed vector in the circumferential direction barely occurs in the vortex flow flowing out from the blade grooves, and pump efficiency is not satisfactory.

In the preferred embodiment, because the connection portion 66 between the opening edge portion 62 and the opening edge portion 64 has a curved shape, fuel smoothly flows into the blade grooves, so that it is possible to prevent the occurrence of reverse fuel flow.

Further, because the opening edge portion 62 has a curved shape, the orientation of the vortex flow may be smoothly changed, and a speed vector in the circumferential direction is likely to occur. Also, because the connection 65 between the opening edge portion 62 and the opening edge portion 63 has a curved shape, a speed vector in the circumferential direction occurs in the vortex flow flowing out from the blade grooves. With such a construction, pump efficiency is further improved. Additionally, by forming the connection portions 67 and 68 between the opening edge portion 61 and the opening edge portions 63 and 64 into a curved shape, fluid resistance may be reduced and pump efficiency is also improved.

On the other hand, vapor (air bubbles) is generated as fuel temperature rises. If the vapor flows into flow line 36 through inlet opening 19 and becomes trapped in the blade grooves, pump efficiency is decreased. Therefore, in known electro-drive type fuel pumps, a vapor exhaust port 37 that exhausts vapor existing in the blade grooves is provided in one flow line groove 35 of the pump cover 5 or the pump body 18. However, vapor in the blade grooves on the opposite side of vapor exhaust port 37 is not immediately expelled by the vapor exhaust port 37.

Figure 13:
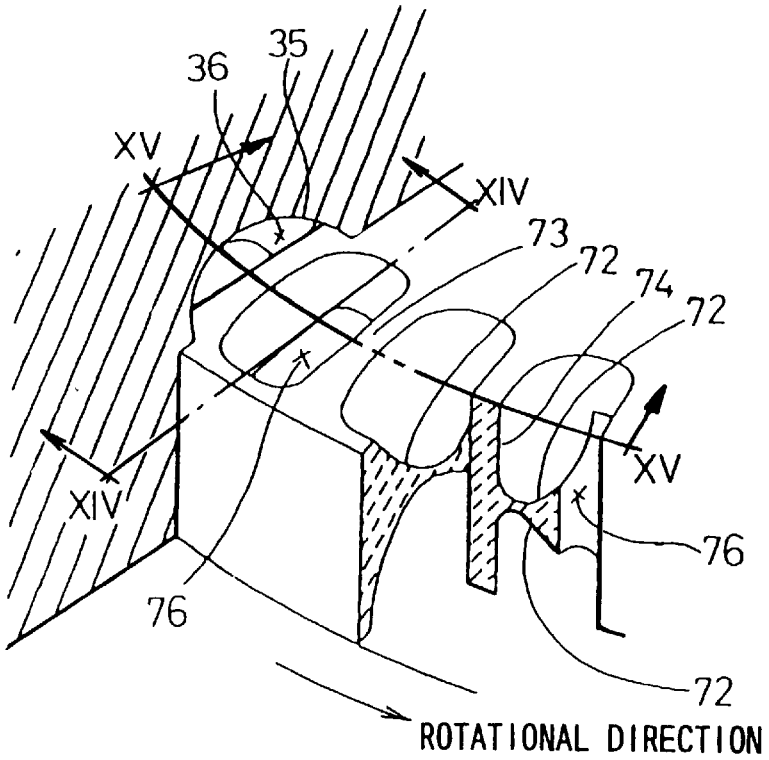
FIG. 13 is a fragmentary sectional view of an impeller according to a fifth preferred embodiment.
Figure 14:
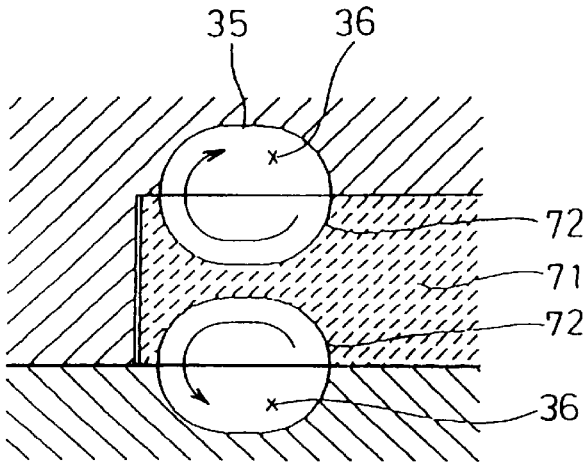
FIG. 14 is a sectional view taken along the line XIV—XIV in FIG. 13.
Figure 15:
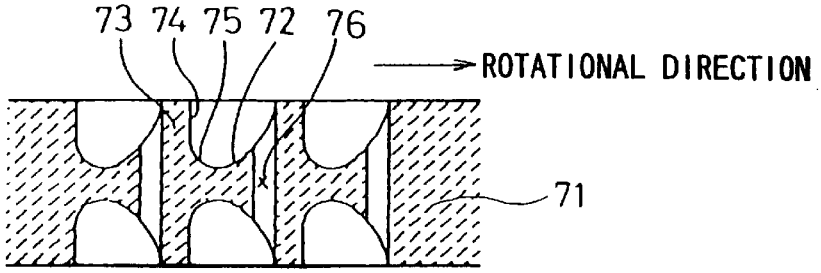
FIG. 15 is a sectional view taken along the line XV—XV in FIG. 13.

FIGS. 13 through 15 show a fifth preferred embodiment in which pump efficiency is improved by increasing the vapor exhaust capacity of the blade grooves. FIG. 13 is a fragmentary sectional view showing a blade and a blade groove portion, FIG. 14 is a sectional view (sectional view in the radial direction) taken along the line XIV—XIV in FIG. 13, and FIG. 15 is a sectional view (sectional view in the circumferential direction) taken along the line XV—XV in FIG. 13. A blade groove 72 provided along the circumferential direction at the outer circumference on both sides of an impeller 71 has a curved shape as shown in FIG. 14, when observed in sectional view thereof in the radial direction. Further, as shown in FIG. 15, a connection portion 75 between the blade groove 72 and the end face 74 on the rear side of the rotational direction of the blade 73 has a curved shape, for example, a circular shape, when observed in sectional view in the circumferential direction. It also has a curved shape, for example, a circular shape, from the front side of the rotational direction to the connection portion 75.

Figure 16:
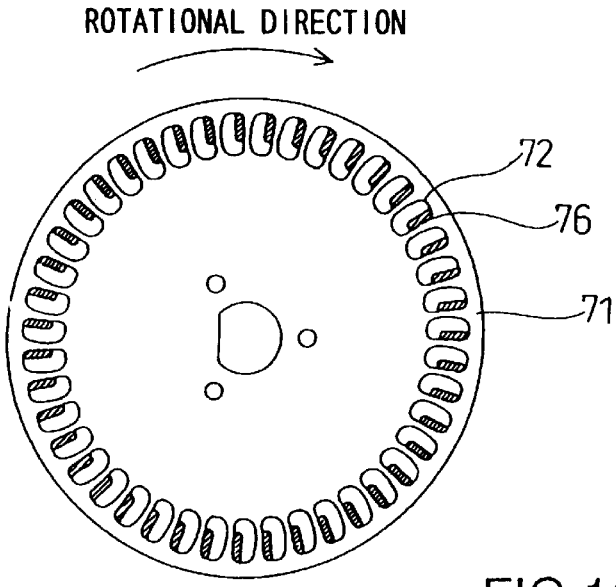
FIG. 16 is a plan view of the impeller according to the fifth preferred embodiment.
Figure 17:
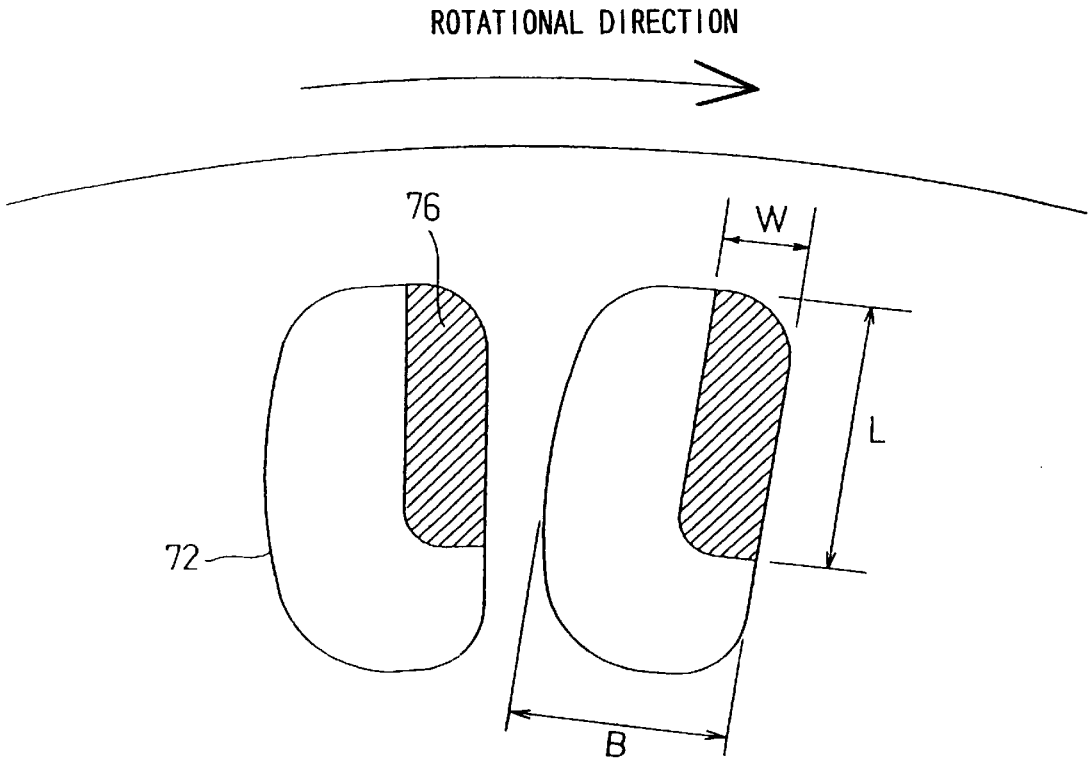
FIG. 17 is a fragmentary enlarged view of the impeller according to the fifth preferred embodiment.

Because vortex flow in the blade groove 72 occurs at the rear side of the rotational direction, the pressure in the blade groove 72 at the front side of the rotational direction is reduced. Therefore, vapor in the blade groove 72 accumulates at the front side of the rotational direction. Accordingly, a hole 76 is formed in the front side of the rotational direction in the blade groove 72 to communicate with the blade groove 72 secured on both sides of the impeller 71. FIG. 16 shows a plan view of an impeller in which a communicating hole 76 communicates with the blade groove 72 and FIG. 17 shows a fragmentary enlarged view of the blade and the blade groove. Although it is possible to appropriately establish the width W of the communicating hole 76 in the circumferential direction, the width W is preferably two-thirds or less than the width B of the blade groove 72 in the circumferential direction. Further, it is possible to adequately determine a length L of the communicating hole 76 in the radial direction. Finally, the shape of the blade groove 72 can be varied or modified as shown in FIGS. 7 through 11.

By providing a communicating hole 76, which communicates with the blade groove 72, in the front side of the rotational direction in the blade groove, vapor in the blade groove 72 that has accumulated on the side opposite of the vapor exhaust port 37 is channeled via the communicating hole 76 into the blade groove 72 formed on the side in which the vapor exhaust port 37 is disposed and is expelled through the vapor exhaust port 37. Therefore, the vapor exhaust capacity of the blade grooves is improved on the opposite side that the vapor exhaust port 37 is disposed. Therefore, pump efficiency is improved.

Figure 1:
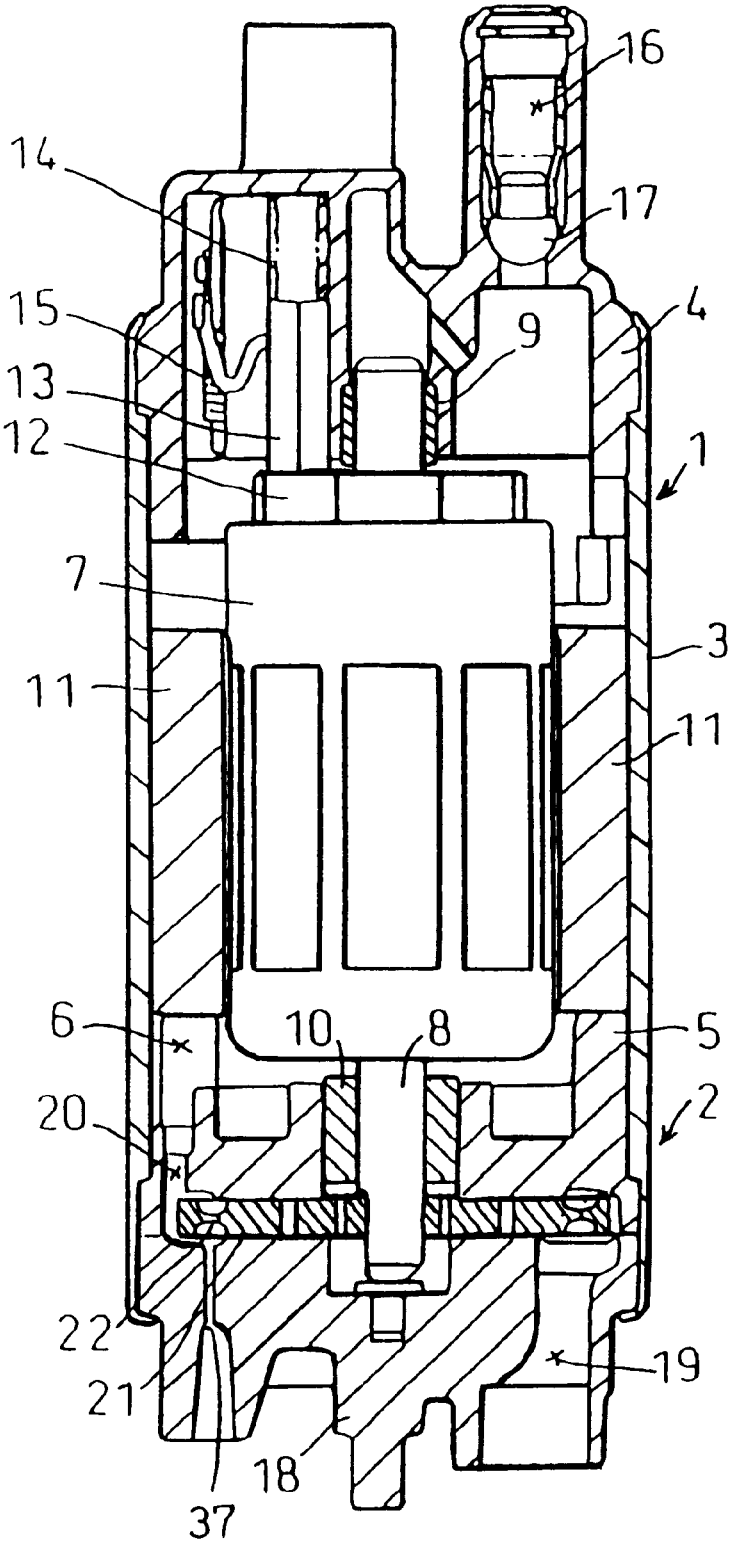
FIG. 1 is a schematic view of a known electro-drive type fuel pump.
Figure 2:
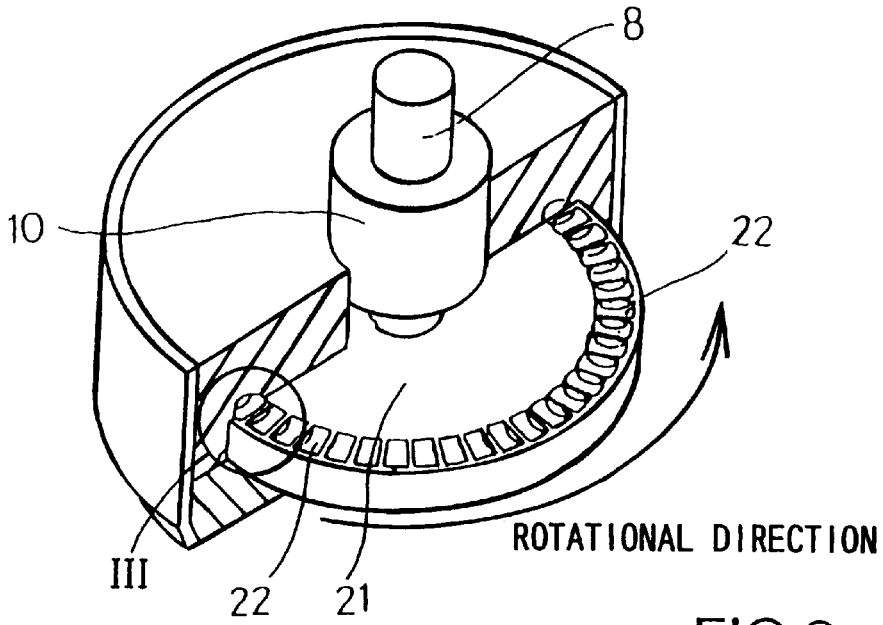
FIG. 2 is a perspective view of the known impeller.
Figure 3:
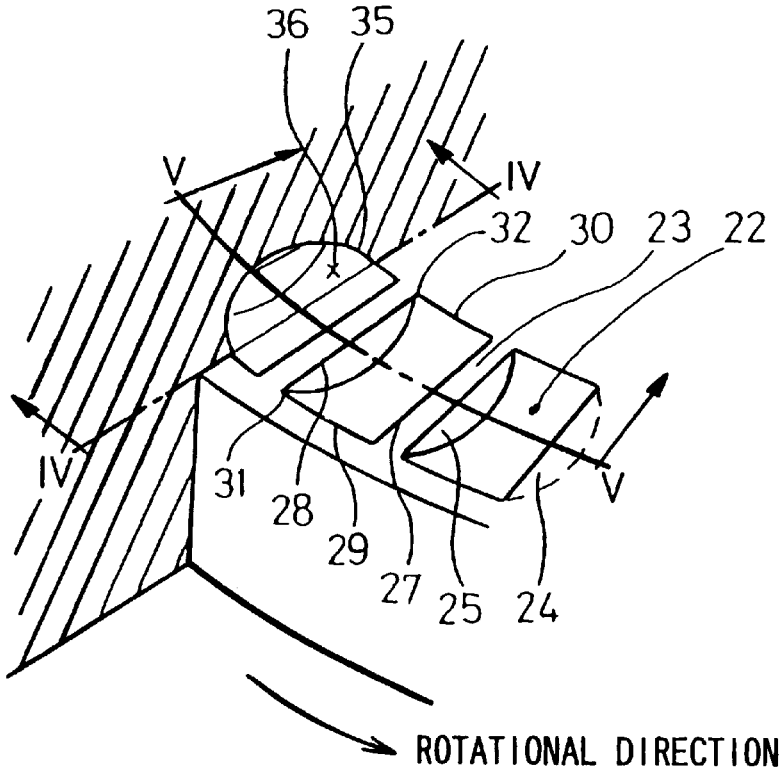
FIG. 3 is an enlarged view of part III of FIG. 2.
Figure 4:
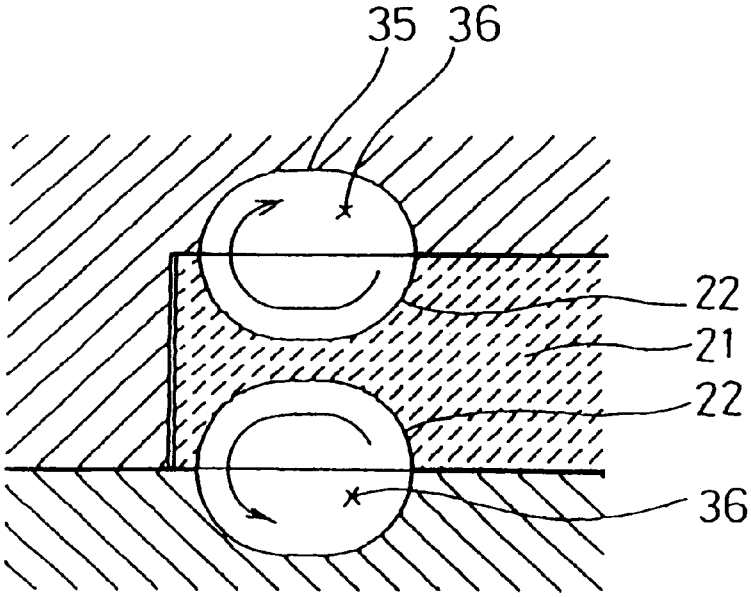
FIG. 4 is a sectional view taken along the line IV—IV in FIG. 3.

However, as shown in FIG. 1, many examples exist in which the inlet opening 19 is provided on the pump body 18 side and the outlet opening 20 is provided on the pump cover 5 side. Therefore, fuel that has accumulated in the blade groove on the side opposite to the side in which the outlet opening 20 is provided, i.e. the pump body 18 side as shown in FIG. 1, can not easily flow out to the outlet opening 20 side.

Figure 18:
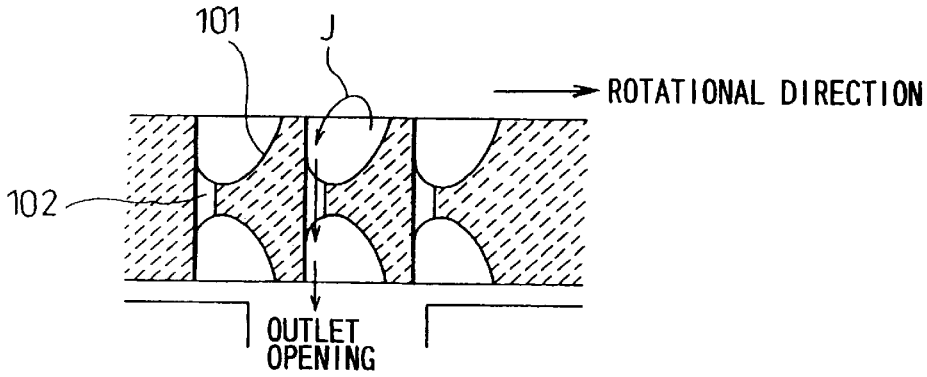
FIG. 18 is a circumferentially sectional view of an impeller according to a sixth preferred embodiment.
Figure 19:
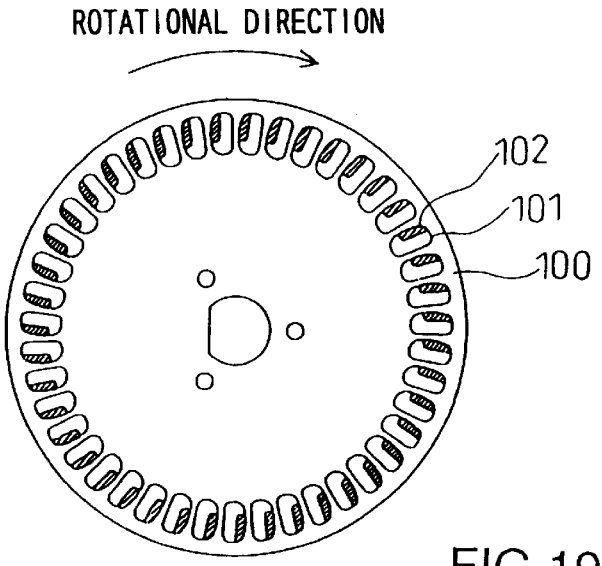
FIG. 19 is a plan view of the impeller according to the sixth preferred embodiment.
Figure 20:
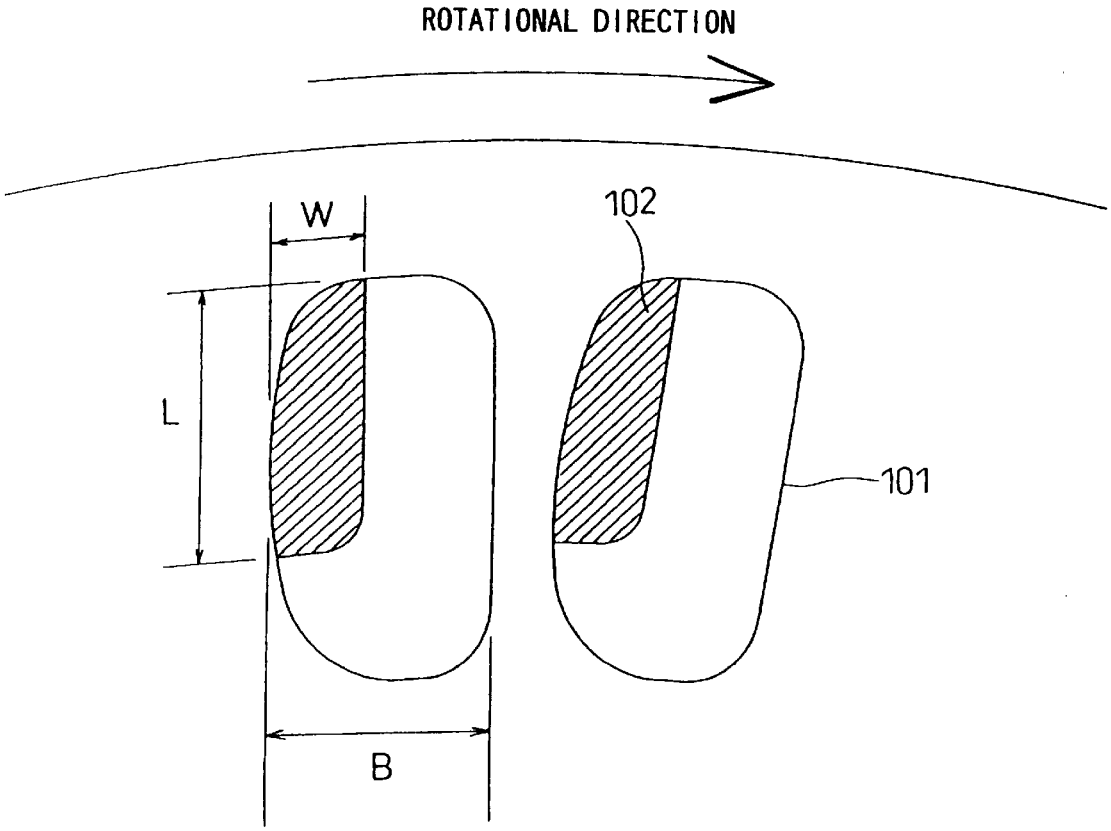
FIG. 20 is a fragmentary enlarged view of the impeller according to the sixth preferred embodiment.

Accordingly, a sixth preferred embodiment in which pump efficiency is improved by increasing the discharge capacity of fuel in the blade grooves is illustrated in FIGS. 18 through 20, wherein FIG. 18 is a sectional view in the circumferential direction, FIG. 19 is a plan view of the impeller, and FIG. 20 is a fragmentary enlarged view showing a blade and a blade groove. In this preferred embodiment, a hole 102 is provided on the rear side of the rotational direction of the blade groove 101 to communicate with a blade groove 101 attached to both sides of the impeller 100. The width W of the communicating hole 102 in the circumferential direction and length L thereof in the radial direction can be adequately determined. Preferably, the width W of the communicating hole 102 in the circumferential direction is set to three-fourths of the width B or less of the blade groove in the circumferential direction.

Because vortex flow in the blade groove 101 is generated on the rear side of the rotational direction, the pressure in the blade groove 101 at the rear side of the rotational direction is increased. For this reason, when the blade groove 101 reaches the position of the outlet opening 20, as shown by the arrow J in FIG. 18, the fuel in the blade groove 101 formed at the opposite side of the side where the outlet opening 20 is provided can easily flow out from the outlet opening 20 through the communicating hole 101. Therefore, pump efficiency is further improved.

Figure 21:
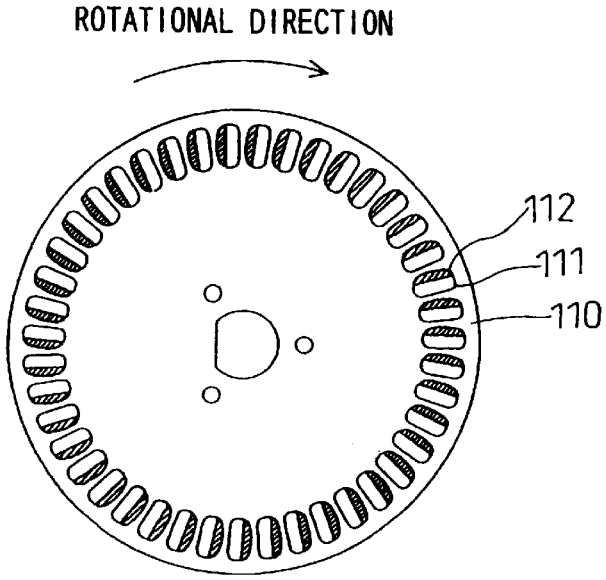
FIG. 21 is a plan view of an impeller according to a seventh preferred embodiment.
Figure 22:
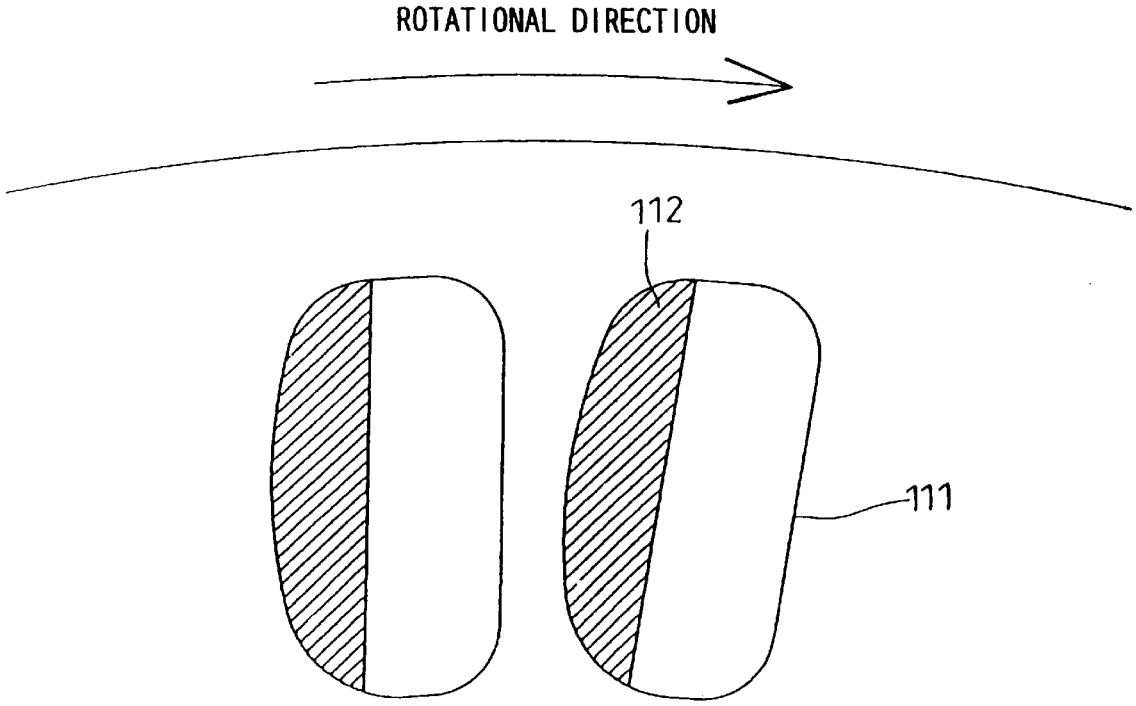
FIG. 22 is a fragmentary enlarged view of the impeller according to the seventh preferred embodiment.

A seventh preferred embodiment in which the length of the communicating hole in the radial direction is changed is illustrated in FIGS. 21 and 22, wherein FIG. 21 is a plan view of an impeller, and FIG. 22 is a fragmentary enlarged view showing a blade and a blade groove. In the preferred embodiment, the communicating hole 112 extends over the blade groove 111 in the radial direction.

Figure 23:
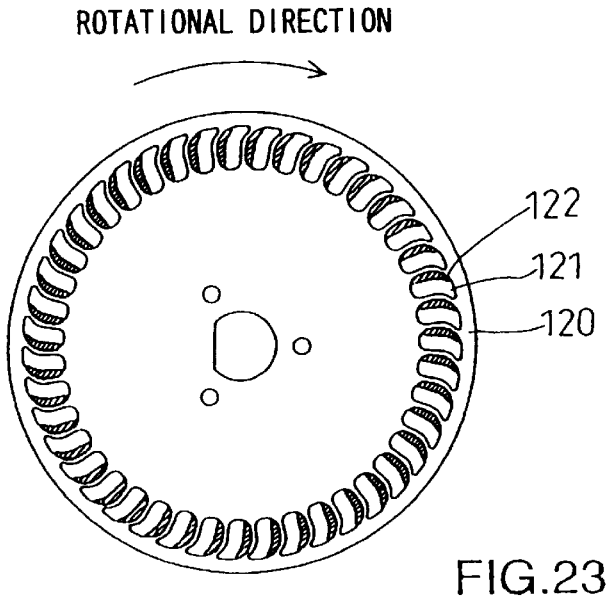
FIG. 23 is a plan view of an impeller according to an eighth preferred embodiment.
Figure 24:
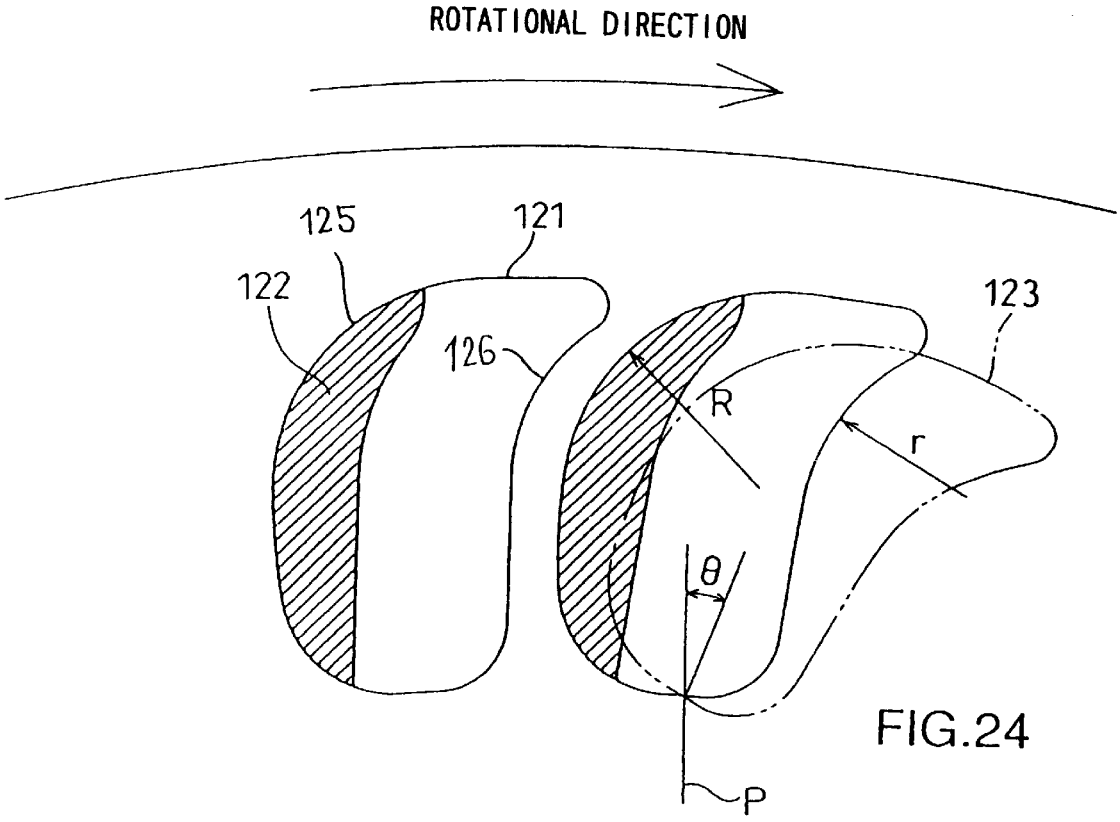
FIG. 24 is a fragmentary enlarged view of the impeller according to the eighth and ninth referred embodiments.

It is also possible to improve pump efficiency by forming the connection portion between the opening edge portions of the opening portions of the blade grooves into a curved or bent shape. An eighth preferred embodiment in which the opening portions of the blade grooves have a curved or bent shape is shown in FIGS. 23 and 24, wherein FIG. 23 is a plan view of an impeller, and FIG. 24 is a fragmentary enlarged view showing a blade and a blade groove.

In this preferred embodiment, the connection portion 125 between the opening edge portion in the radial direction at the rear side of the rotational direction of the opening portion of the blade groove and the opening edge portion in the circumferential direction outward of the radial direction has a curved shape, for example a circular shape, having a radius R relative to the rotational direction. Further, the radius R is preferably set in a range from two-thirds S to one-fourth S where it is assumed that the plate thickness of the impeller is S.

In the preferred embodiment, the connection portion 126 between the opening edge portion in the radial direction at the front side of the rotational direction of the opening portion of the blade portion and the opening edge portion in the circumferential direction outward of the radial direction has a curved shape, for example a circular shape, having a radius r relative to the rotational direction. With regard to the other connection portions, they are formed as shown in FIG. 11. Furthermore, a connection portion that has a curved shape relative to the rotational direction may be provided on only one side, and the curved shape may be elliptical. By forming the connection portion between the opening edge portions of the blade groove portions into a curved shape, fluid resistance can be suppressed to a lower level, and it is possible to increase the circumferential speed of the vortex flow. Therefore, pump efficiency can be improved.

Further, by inclining the opening portion of the blade groove relative to the radial direction, pump efficiency can be improved. A ninth preferred embodiment in which the opening portion of the blade portion is inclined relative to the radial direction is illustrated in FIG. 24. In this preferred embodiment, as shown by a two-dashed line in FIG. 24, the opening portion is formed, being turned a predetermined degree of angle θ to the front side of the rotational direction relative to a straight line P in the radial direction. It is also possible to adequately set an inclination method and an inclination angle θ of the opening portion. In this case, fluid resistance can be suppressed to a lower level, and pump efficiency can be improved.

In the above description, communicating holes are provided at the same position relative to the blade grooves at both sides of the impeller. However, the disposing position of the communicating hole relative to the blade groove at one side of the impeller is made different from that of the communicating hole at the other side. That is, the communicating holes may be disposed with their positions shifted relative to the blade grooves at both sides of the impeller, so that pump efficiency can also be improved.

Figure 25:
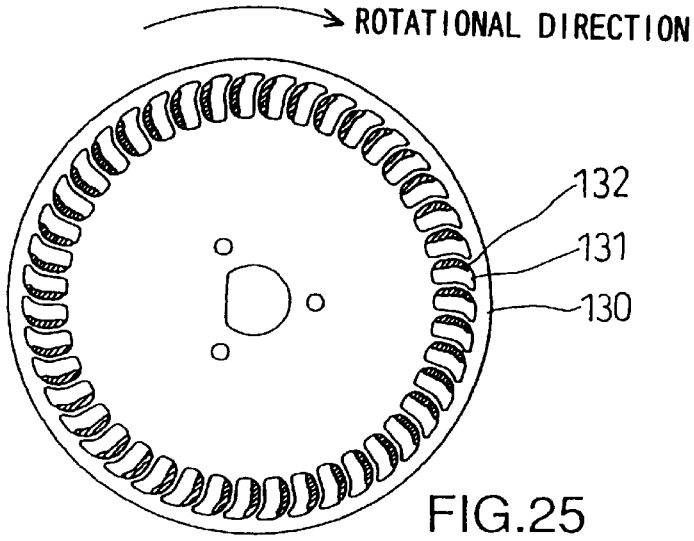
FIG. 25 is a plan view at the inlet opening side of an impeller according to a tenth referred embodiment.
Figure 26:
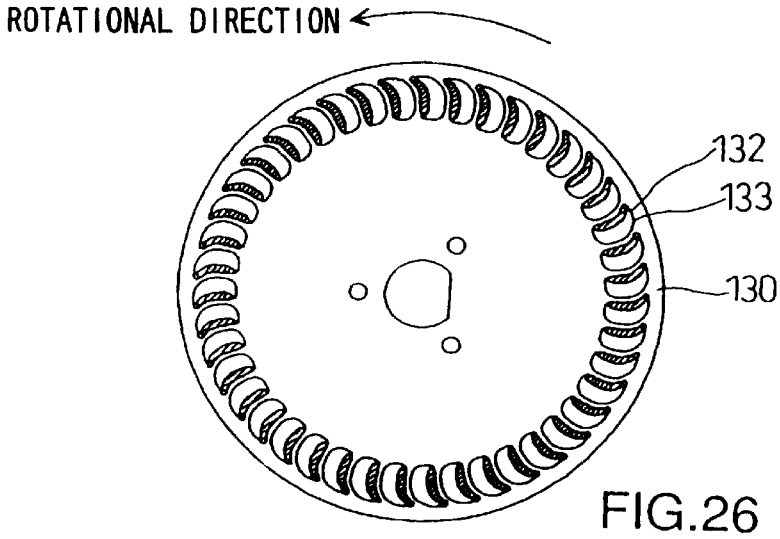
FIG. 26 is a plan view at the outlet opening side of the impeller according to the tenth referred embodiment.
Figure 27:
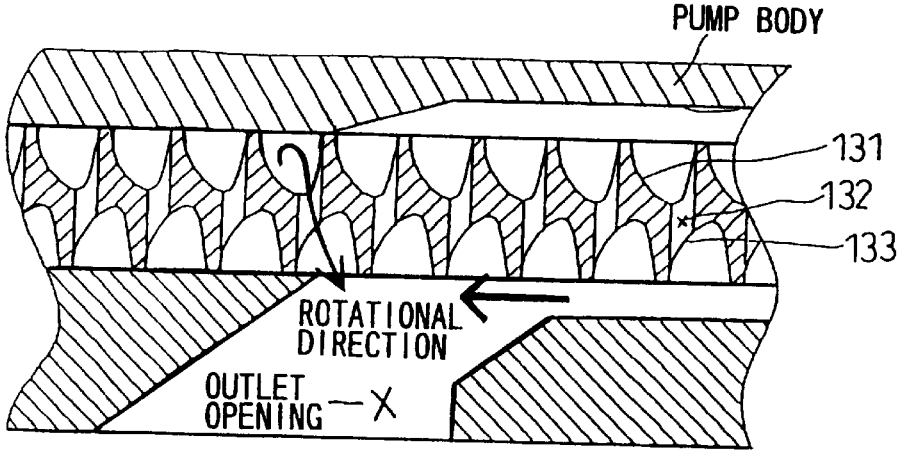
FIG. 27 is a circumferentially sectional view of the impeller of the tenth preferred embodiment.

The tenth preferred embodiment is shown in FIGS. 25 through 27, wherein FIG. 25 is a plan view (facing the inlet side) of the inlet opening side of an impeller 130, FIG. 26 is a plan view (facing the outlet side) of the outlet opening side of the impeller, and FIG. 27 is a sectional view of the impeller in the circumferential direction. In the preferred embodiment, the blade groove 133 at the outlet opening side has been shifted to the rear side of the rotational direction relative to the blade groove 131 at the inlet opening side so that a communicating hole is disposed rearward of the rotational direction in the blade groove 131 at the inlet opening side and is disposed at the front side in the rotational direction in the blade groove 133 at the outlet opening side. Thus, because the blade groove 133 at the outlet opening side has been shifted rearward of the rotational direction relative to the blade groove 131 at the inlet opening side, fuel in the blade groove 131 at the inlet opening side is discharged into the outlet opening via the communicating hole 132 and the blade groove 133 at the outlet opening side when the blade groove 131 at the inlet opening side is partitioned by the body, whereby fuel in the blade groove 131 opposite to the side where the outlet opening is provided can be easily discharged into the outlet opening, and pump efficiency is improved. Further, because the positions of the blades are shifted on both sides of the impeller, impulse occurring at the partition of the blades is dispersed. Therefore, impulse noise due to high frequency can be reduced.

Figure 28:
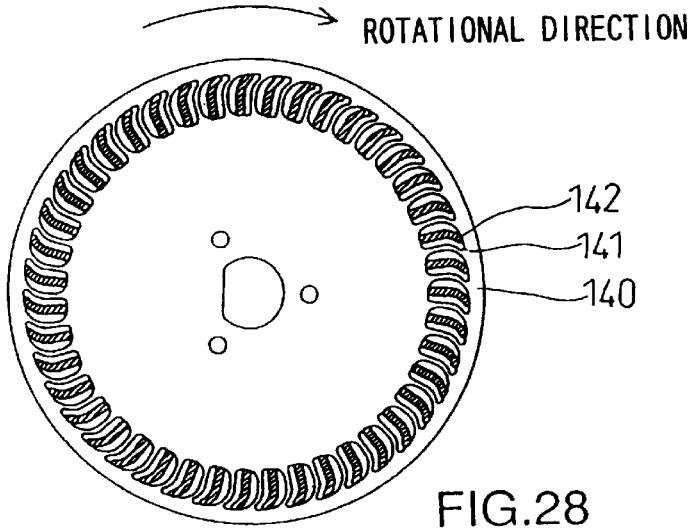
FIG. 28 is a plan view at the inlet opening side of an impeller according to an eleventh preferred embodiment.
Figure 29:
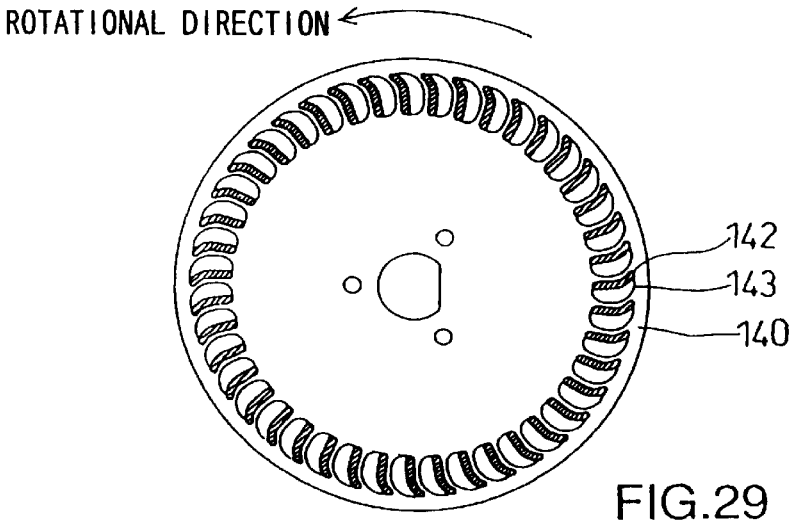
FIG. 29 is a plan view at the outlet opening side of the impeller according to the eleventh preferred embodiment.
Figure 30:
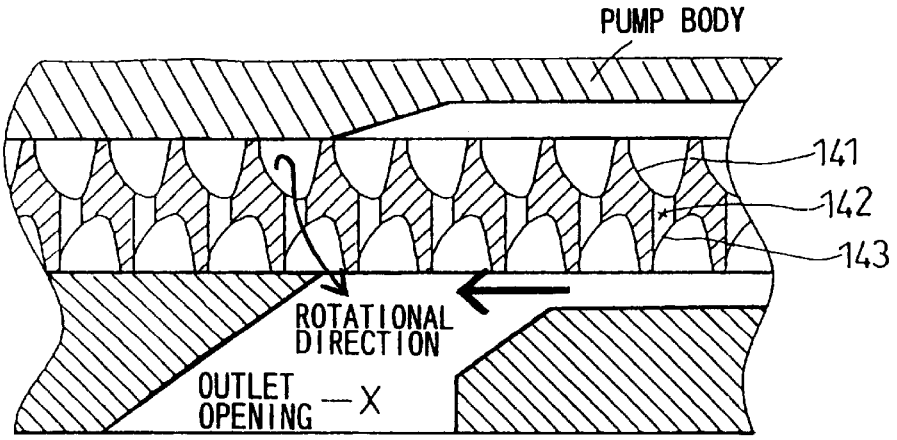
FIG. 30 is a circumferentially sectional view of the impeller according to the eleventh preferred embodiment.

It is possible to adequately change the shifting distance between the blade grooves at the inlet opening side and those at the outlet opening side. An eleventh preferred embodiment is illustrated in FIGS. 28 through 30, in which the shifting distance between the blade grooves at the inlet opening side and those at the outlet opening side is established such that the communicating holes are disposed at the middle of the blade grooves at the inlet opening side. Also, in the preferred embodiment, because fuel can be easily discharged from the blade grooves at the inlet opening side to the outlet opening via the blade grooves at the outlet opening side, pump efficiency is improved.

FIGS. 31 through 37 show changes in pump efficiency when the shape, size of the blade grooves, disposing position of communicating holes, etc., are changed. The pump efficiency is obtained by the expression, pump efficiency=$g\times(P\times Q)/(T\times N)$, wherein g is gravity acceleration, T is motor torque, N is the number of revolutions of motor, P is fuel pressure, and Q is a quantity of fuel. Further, the measured values shown in FIGS. 31 through 37 were obtained for an impeller in which the outer circumferential diameter E of the impeller is 33 mm, the outer diameter T of the impeller is 31 mm, the impeller plate thickness S is 3.8 mm, and the number of blades is 43. Refer to FIG. 36A and FIG. 36B for the outer circumferential diameter E of the impeller, outer diameter T thereof, and plate thickness S thereof.

Figure 31A:
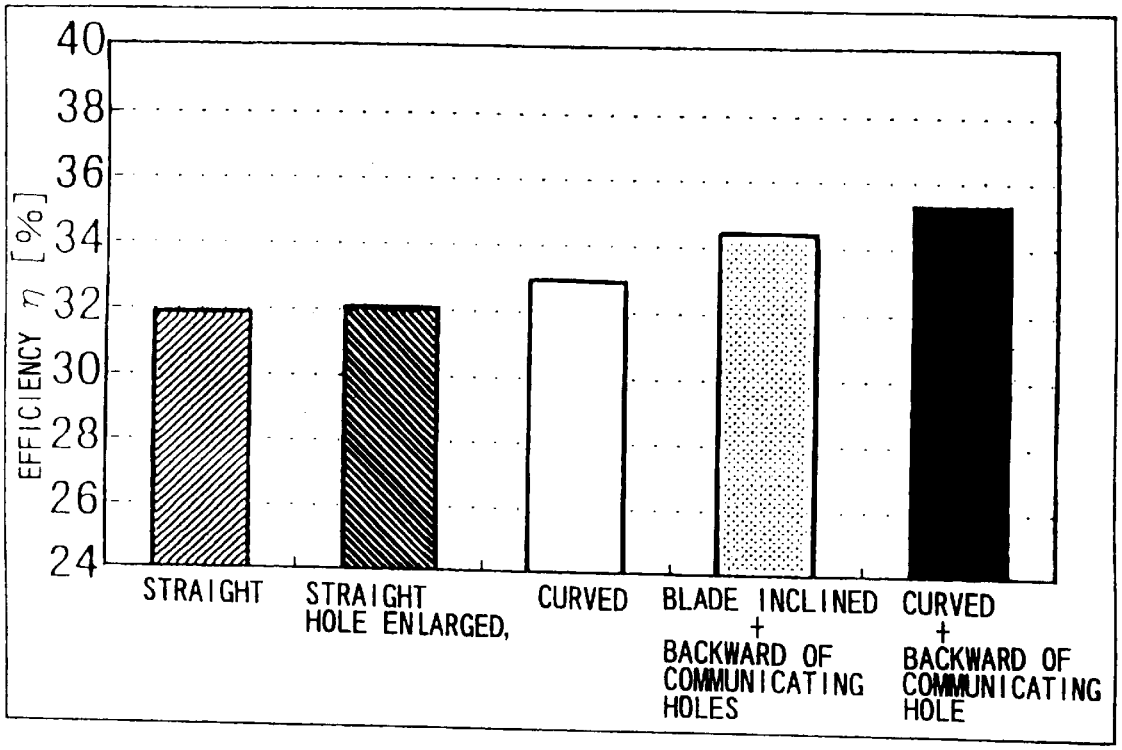
FIG. 31A is a graph showing the relationship between the disposing position of communicating holes and pump efficiency.
Figure 31B:
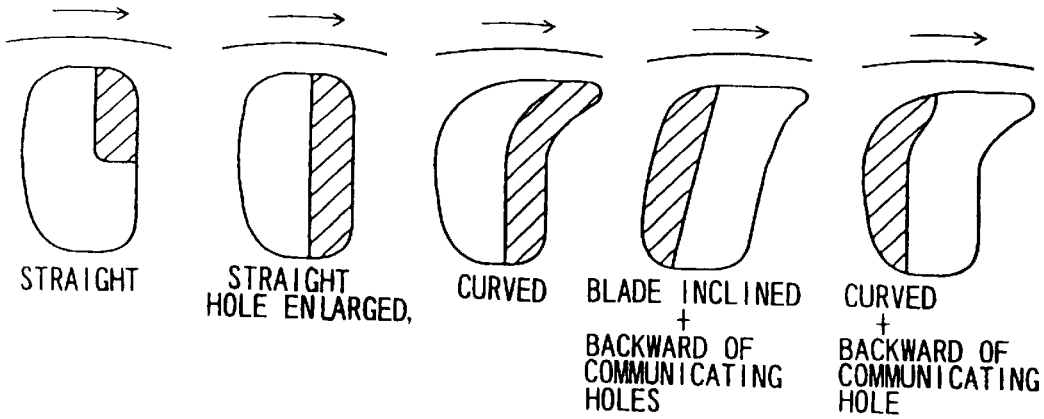
FIG. 31B is a view showing the shape of the opening portion of blade grooves.

FIG. 31A and FIG. 31B show the shape of an opening portion of a blade groove, and the relationship between the disposing position of a communicating hole and the pump efficiency. Herein, the term "straight" means that, for example, the shape of an opening portion of a blade groove is formed as shown in FIG. 17, a communicating hole is provided at the front side of the rotational direction of the blade groove, and at the same time, the length of the communicating hole in the radial direction is made shorter than the length of the blade groove in the radial direction.

The term "straight, hole enlarged" means that the communicating hole is provided to extend the blade groove in the radial direction although the shape of the opening portion of the blade groove is the same as that in the definition of "straight."

The term "curved" means that, as shown in FIG. 24, the connection portion 125 between the opening edge portion in the radial direction rearward of the rotational direction of the opening portion 121 of the blade groove and the opening edge portion in the circumferential direction outward of the radial direction, and the connection portion 126 between the opening edge portion in the radial direction at the front side of the rotational direction and the opening edge portion in the circumferential direction outward of the radial direction have a curved shape relative to the rotational direction, and the communicating hole is provided to extend over the blade groove in the radial direction at the front side of the rotational direction.

The term "blade inclined+rearward of communicating hole" means that, as shown in FIG. 24, the opening portion 123 of the blade groove has been inclined relative to the radial direction, and at the same time, the communicating hole is provided rearward of the rotational direction.

The term "curved +rearward of the communicating hole" means that the opening portion of the blade grooves has a curved shape, and the communicating hole thereof is provided at the rear side of the rotational direction of the blade grooves. As shown in FIG. 31A, although pump efficiency differs depending upon the shape of the opening portion of the blade grooves and the disposing position of the communicating hole, pump efficiency is further improved than the pump efficiency (approximately 25%) of the known electro-drive type fuel pump.

Figure 32A:
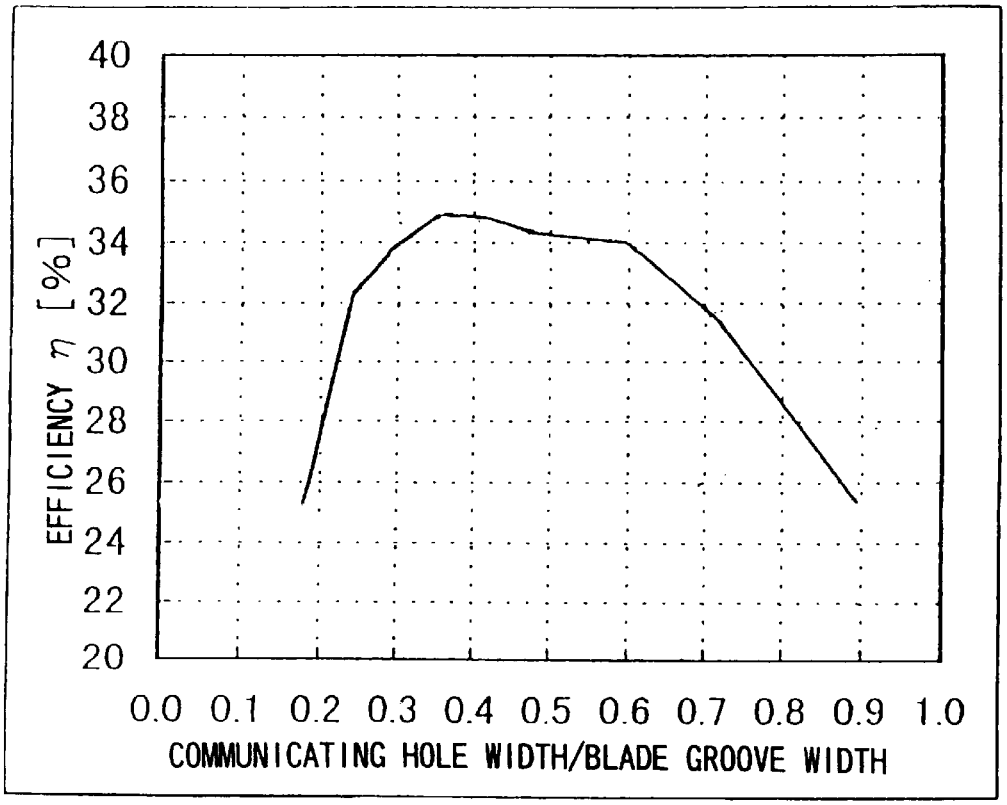
FIG. 32A is a view showing the relationship between the communicating hole width/blade groove width and pump efficiency.
Figure 32B:
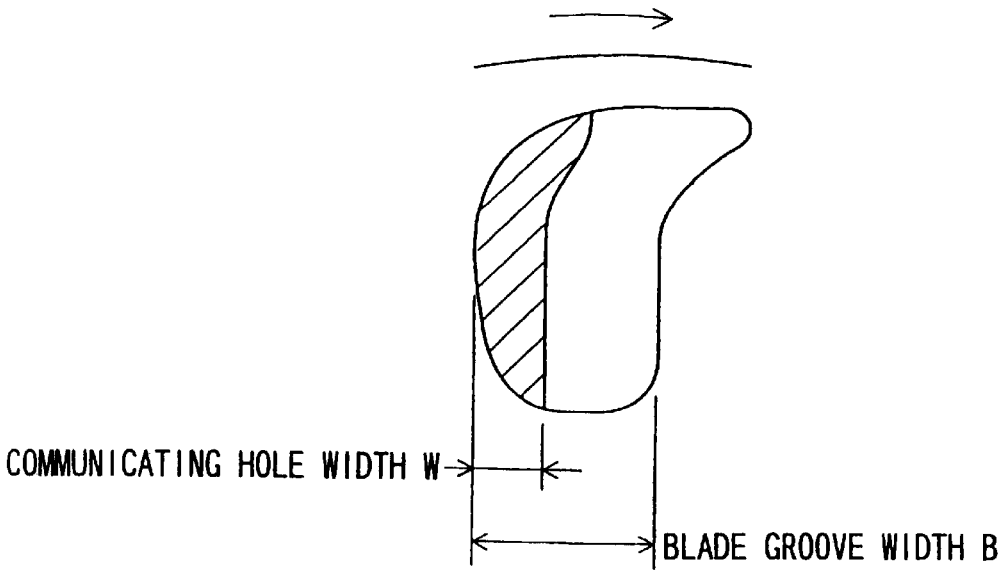
FIG. 32B is a view showing the relationship between the communicating hole width and the blade groove width.

FIG. 32A and FIG. 32B show the relationship between the width of the communicating hole/width of blade grooves and the pump efficiency. Herein, at the blade groove, the width thereof is a length B of the blade groove in the circumferential direction, and at the communicating hole, the width thereof is a length W of the middle portion of the communicating hole in the circumferential direction. If the ratio of the communicating hole width to the blade groove width is set in a range from 0.2 to 0.9, pump efficiency is further improved than that of the known electro-drive type fuel pump. More preferably, the range is 0.3 to 0.6.

Figure 33A:
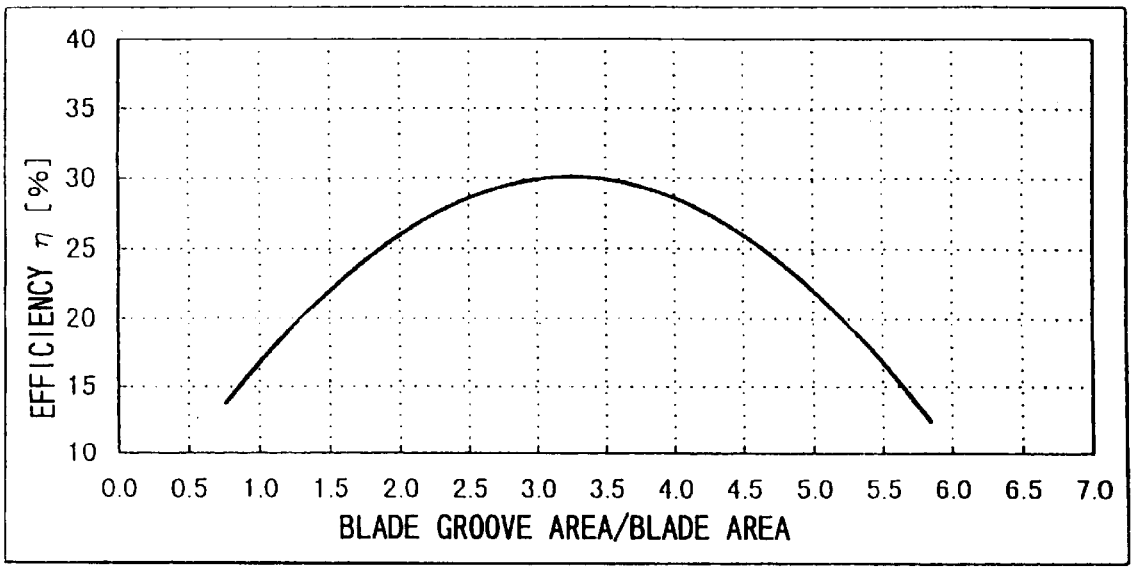
FIG. 33A is a view showing the relationship between the blade groove area/blade area and pump efficiency.
Figure 33B:
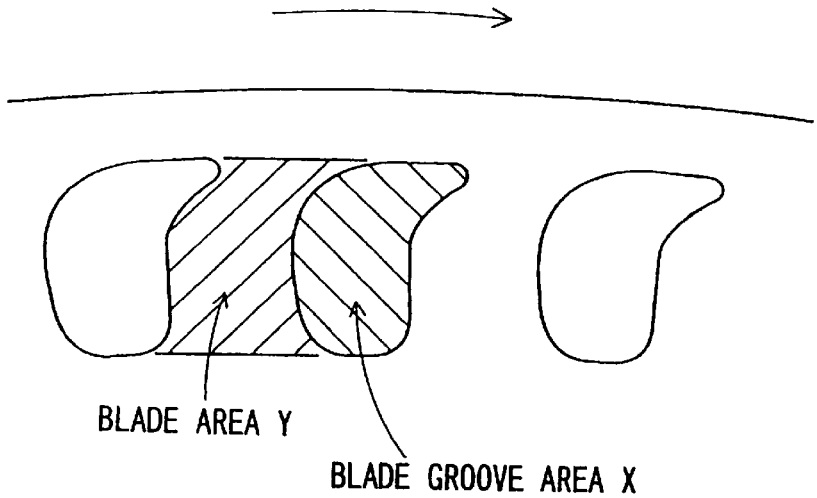
FIG. 33B is a view showing the relationship between the blade area and the blade groove area.

FIG. 33A and FIG. 33B show the relationship of the ratio blade groove area/the blade area to the pump efficiency. Herein, the blade groove area is an area X of the opening portion of the blade grooves, and the blade area is an area Y of a blade provided between the blade grooves.

Further, measured values shown in FIG. 33 are based on a case in which the blade area Y is made constant (1.36 mm) while changing the blade groove area. If the ratio of the blade groove area to the blade area is set in a range from 2.0 to 4.5, pump efficiency is further improved than that of the known electro-drive type fuel pump. More preferably, the ratio thereof is set in a range from 2.2 to 4.2.

Figure 34A:
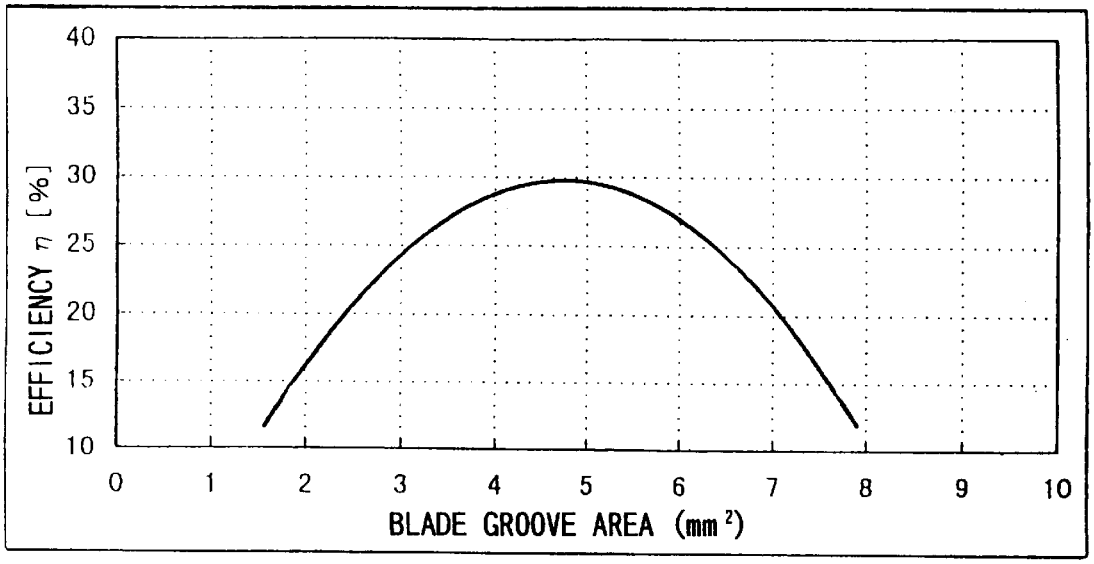
FIG. 34A is a view showing the relationship between the blade groove area and pump efficiency.
Figure 34B:
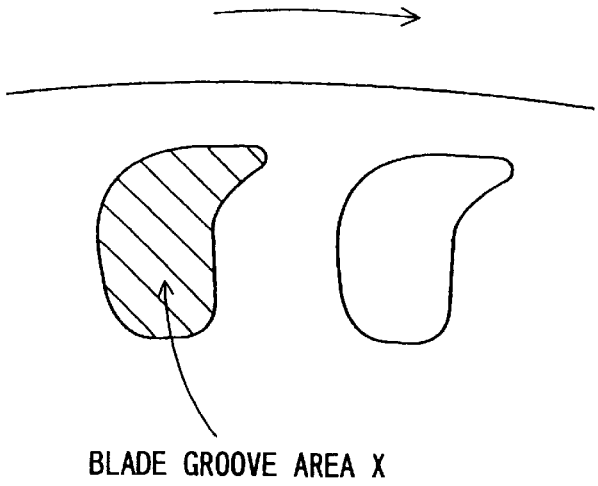
FIG. 34B is a view showing the blade groove area.

FIG. 34A and FIG. 34B show the relationship between the blade groove area and pump efficiency. If the blade groove area is set to 3.2 to 6.3 $mm^2$, pump efficiency is further improved than pump efficiency of the known electro-drive type fuel pump. More preferably, the blade groove area is set in a range from 3.5 to 6 $mm^2$.

Figure 35A:
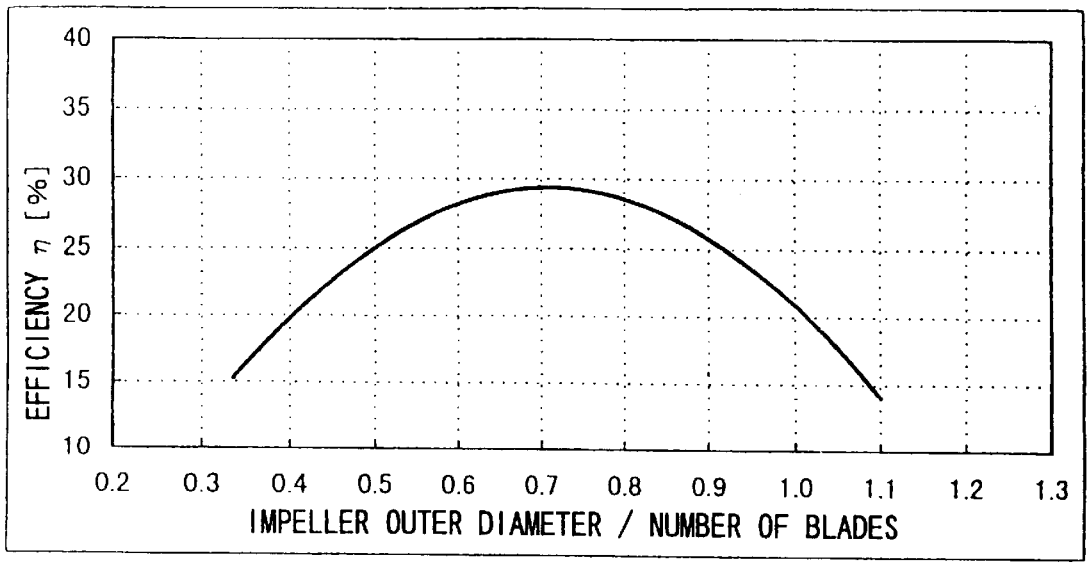
FIG. 35A is a view showing the relationship between the impeller outer diameter/number of blades and pump efficiency.
Figure 35B:
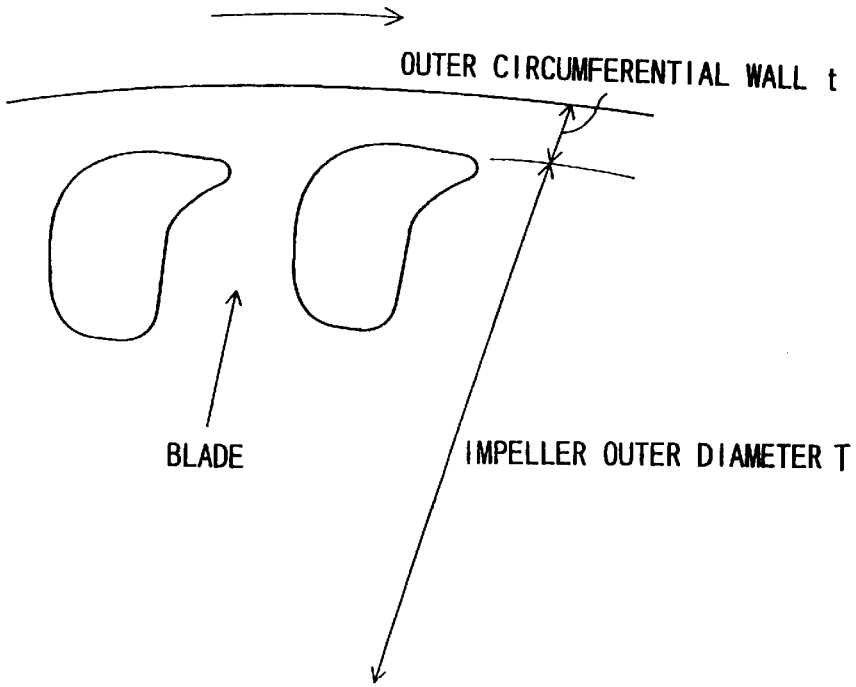
FIG. 35B is a view showing the impeller outer diameter.

FIG. 35A and FIG. 35B show the relationship between the impeller outer diameter/number of blades and the pump efficiency. Herein, the impeller outer diameter T is a distance between the opening edge portions in the circumferential direction of the radial direction outside of the radial direction of the blade grooves (it does not include the width t of the outer circumferential wall), and the number of blades is the number of blades provided for an impeller. The outer circumferential diameter E of the impeller is E=T+2t. Further, measured values shown in FIG. 35A are based on a case in which the outer diameter T of the impeller is made constant (30 mm) while changing the number of blades. If the ratio of the outer diameter of an impeller to the number of blades is set in a range from 0.5 to 0.9, pump efficiency is further improved than the pump efficiency of the known electro-drive type fuel pump. More preferably, the ratio is set in a range from 0.55 to 0.85.

Figure 36A:
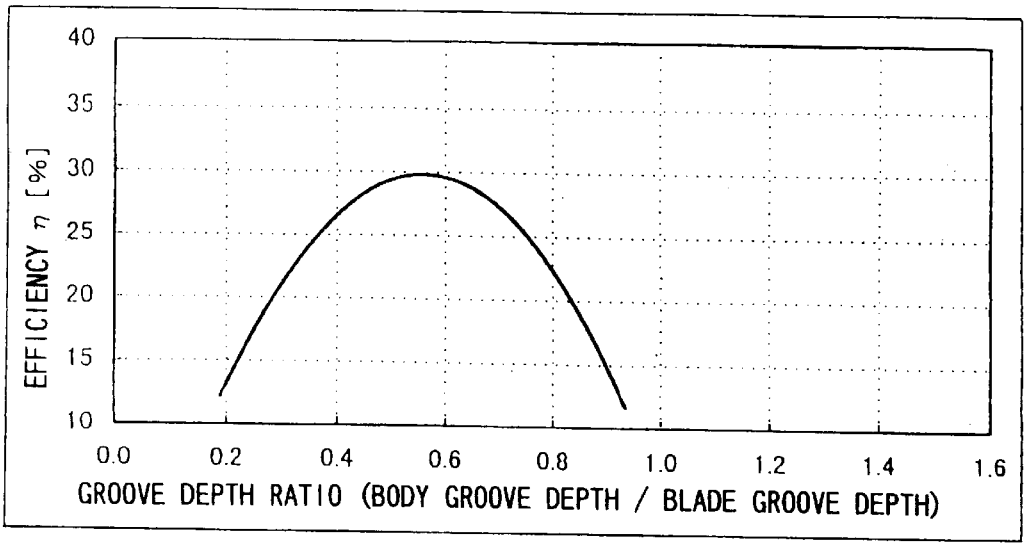
FIG. 36A is a view showing the relationship between the groove depth ratio and pump efficiency.
Figure 36B:
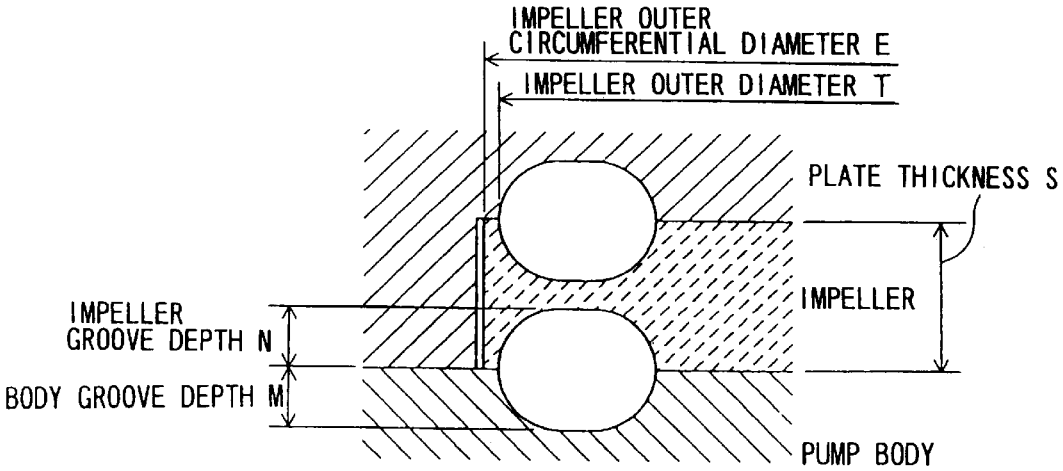
FIG. 36B is a view showing the impeller groove depth and the body groove depth.

FIG. 36A and FIG. 36B show the relationship between the groove depth ratio and the pump efficiency. Herein, the groove depth ratio is a ratio M/N of the depth M of the deepest portion of the flow line groove to the depth N of the deepest portion of the blade grooves. If the groove depth ratio is set in a range from 0.36 through 0.76, pump efficiency is further improved than pump efficiency of the known electro-drive type fuel pump. More preferably, the groove depth ratio is set in a range from 0.4 to 0.75.

Figure 37A:
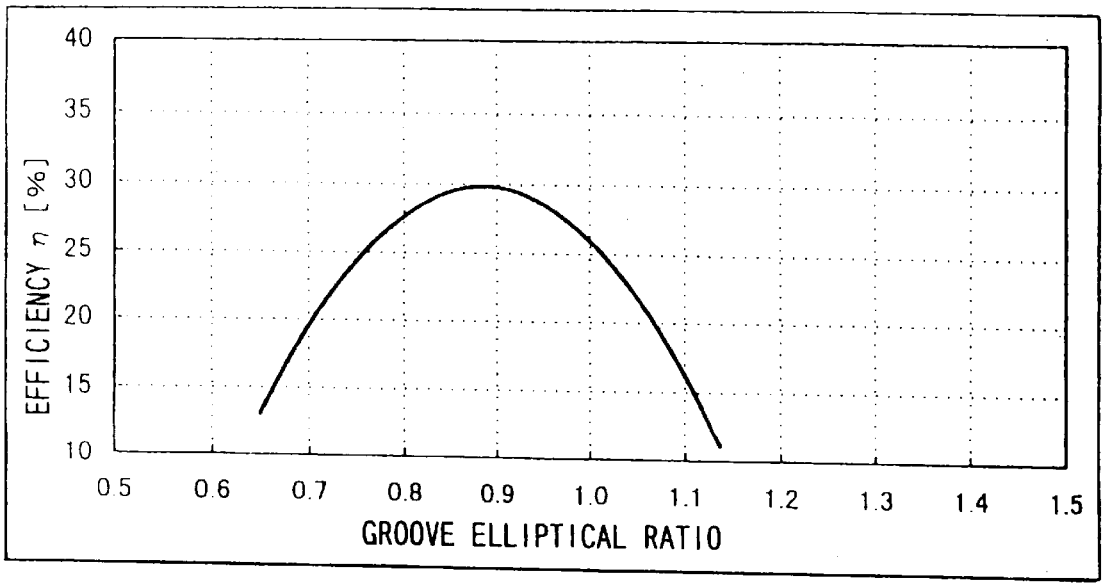
FIG. 37A is a view showing the relationship between the elliptical ratio of the blade grooves and pump efficiency.
Figure 37B:
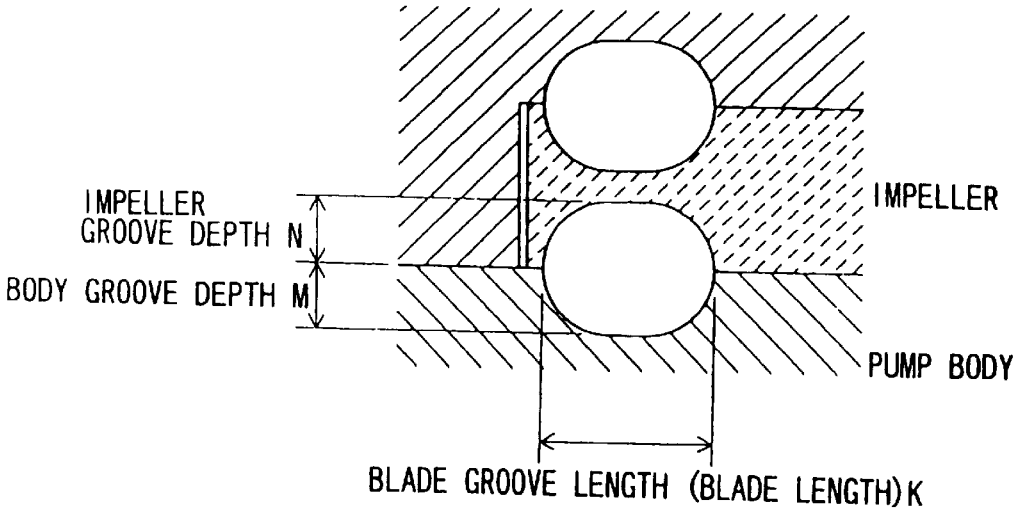
FIG. 37B is a view showing the blade groove length.

FIG. 37A and FIG. 37B show the relationship between the groove elliptical ratio of blade grooves and pump efficiency. Herein, the elliptical ratio of the grooves is a ratio (M+N)/K between the sum of the depth M of the deepest portion of flow line grooves and the depth N of the deepest portion of the blade grooves and the length K of the blade grooves in the radial direction. If the elliptical ratio of the blade grooves is set in a range from 0.75 to 1.1, pump efficiency is further improved than that of the known electro-drive type fuel pump. More preferably, the elliptical ratio is set in a range from 0.8 to 0.97.

In the above description of each of the above-mentioned preferred embodiments, it has been explained that pump efficiency could be improved by changing the shape (curvature, inclination, etc.) of the opening portions of the blade grooves, and changing the arrangement of the communicating holes, and disposing position and size thereof. As a matter of course, these objects can be achieved by various combinations of the above factors.

What is claimed is:

1. An impeller for an electro-drive type fuel pump having blades and blade grooves provided along the circumferential direction, wherein said blade grooves have a curved shape when observed in sectional view thereof in the radial direction, and wherein connection portions between said blade grooves and end faces of said blades at the rear side of the rotational direction have a curved shape when observed in sectional view thereof in the circumferential direction.

2. An impeller for an electro-drive type fuel pump as set forth in claim 1, wherein the curved shape of said connection portions is circular.

3. An impeller for an electro-drive type fuel pump as set forth in claim 1, wherein said blade grooves are formed and inclined from the front side of the rotational direction toward said connection portions when observed in sectional view thereof in the circumferential direction.

4. An impeller for an electro-drive type fuel pump having blades and blade grooves that are provided along the circumferential direction, wherein opening portions of said blade grooves are constructed such that connection portions between opening edge portions in the radial direction at the rear side of the rotational direction and opening edge portions in the circumferential direction outward of the radial direction have a curved shape.

5. An impeller for an electro-drive type fuel pump as set forth in claim 4, wherein the opening portions of said blade grooves are constructed such that the opening edge portions in the radial direction at the rear side of the rotational direction have a curved shape.

6. An impeller for an electro-drive type fuel pump as set forth in claim 4, wherein the opening portions of said blade grooves are constructed such that connection portions between the opening edge portions in the radial direction at the rear side of the rotational direction and the opening edge portions in the circumferential direction inward of the radial direction have a curved shape.

7. An impeller for an electro-drive type fuel pump as set forth in claim 4 wherein communicating holes are formed to communicate between the blade grooves at both sides thereof, said communicating holes being formed at the front side of the rotational direction of said groove blades.

8. An impeller for an electro-drive type fuel pump as set forth in claim 4, wherein communicating holes are formed to communicate between the blade grooves at both sides thereof, said communicating holes being forced at the rear side of the rotational direction of said blade grooves.

9. An impeller for an electro-drive type fuel pump as set forth in claim 4, wherein the blade grooves facing the outlet side are shifted toward the rear side of the rotational direction relative to the blade grooves facing the inlet side.

* * * * *

UNITED STATES PATENT AND TRADEMARK OFFICE

CERTIFICATE OF CORRECTION

PATENT NO. : 6,224,323 B1
DATED : May 1, 2001
INVENTOR(S) : Seiji Murase, et al.

It is certified that error appears in the above-identified patent and that said Letters Patent is hereby corrected as shown below:

Column 14,
Line 15, delete "forced" and insert -- formed -- therefor.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*